US010228201B2

(12) United States Patent
Walther et al.

(10) Patent No.: US 10,228,201 B2
(45) Date of Patent: Mar. 12, 2019

(54) MAGAZINE AND BOLT RELEASE FOR FIREARM

(71) Applicant: WIPH, LLC, St. George, UT (US)

(72) Inventors: Michael H. Walther, St. George, UT (US); Thomas J. Ahey, IV, St. George, UT (US)

(73) Assignee: WIPH, LLC, Washington, UT (US)

( * ) Notice: Subject to any disclaimer, the term of this patent is extended or adjusted under 35 U.S.C. 154(b) by 0 days.

(21) Appl. No.: 15/369,382

(22) Filed: Dec. 5, 2016

(65) Prior Publication Data

US 2017/0160026 A1 Jun. 8, 2017

Related U.S. Application Data

(60) Provisional application No. 62/263,175, filed on Dec. 4, 2015.

(51) Int. Cl.

| | |
|---|---|
| ***F41A 3/66*** | (2006.01) |
| ***F41A 3/68*** | (2006.01) |
| ***F41A 17/36*** | (2006.01) |
| ***F41A 35/06*** | (2006.01) |

(52) U.S. Cl.
CPC *F41A 3/66* (2013.01); *F41A 3/68* (2013.01); *F41A 17/36* (2013.01); *F41A 35/06* (2013.01)

(58) Field of Classification Search
CPC .... F41A 3/66; F41A 3/68; F41A 17/36; F41A 35/06
USPC ..... 42/18, 6
See application file for complete search history.

(56) References Cited

U.S. PATENT DOCUMENTS

| | | | |
|---|---|---|---|
| 1,247,528 | A | 11/1917 | Hammond |
| 1,533,966 | A | 4/1925 | Browning |
| 4,128,042 | A | 12/1978 | Atchisson |
| 4,664,015 | A | 5/1987 | Kennedy |
| 5,519,954 | A | 5/1996 | Garrett |

(Continued)

OTHER PUBLICATIONS

Notification of Transmittal of the International Search Report and the Written Opinion of the International Searching Authority, or the Declaration; International Patent Application No. PCT/US2016/064964, WIPH, LLC (Walther, Michael H., et al); dated Feb. 24, 2017.

*Primary Examiner* — Joshua E Freeman
(74) *Attorney, Agent, or Firm* — Gurr Brande & Spendlove, PLLC

(57) ABSTRACT

An integrated magazine and bolt release mechanism that is intended to automate the operations of magazine release when empty, and bolt release when a loaded magazine is inserted into the rifle. The release mechanism may include a mechanical switch device. The mechanical switch device may be a lever that is able to identify the presence of ammunition. By way of mechanical linkage, the system is able to control the magazine catch surface to either maintain or expel a magazine. The linkage facilitate the transition of vertical motion, imparted by the magazine body and follower to the lever into horizontal motion of an arm to move the magazine catch in and out of engagement with the magazine's locking surface. Upward vertical motion of the lever may actuate the bolt catch surface by means of a mechanical link that serves to reverse the direction of vertical motion. As the magazine body moves upward, the lever impinges on the arm that forces the bolt catch downward, to release the locked bolt group.

15 Claims, 48 Drawing Sheets

(56) References Cited

U.S. PATENT DOCUMENTS 6,070,352 A * 6/2000 Daigle ..... F41A 11/02 42/49.02
6,907,814 B2 6/2005 Spinner et al.
7,047,864 B2 5/2006 Spinner et al.
7,219,462 B2 5/2007 Finn
7,661,219 B1 2/2010 Knight, Jr. et al.
7,798,045 B1 9/2010 Fitzpatrick et al.
7,849,777 B1 12/2010 Zadrosser
8,156,854 B2 4/2012 Brown
8,161,861 B2 4/2012 Haley et al.
8,261,652 B2 * 9/2012 Findlay ..... F41A 35/06 42/70.02
8,327,749 B2 12/2012 Underwood
8,359,966 B1 1/2013 Brotherton
8,387,296 B2 3/2013 Overstreet et al.
8,479,635 B2 7/2013 Overstreet et al.
8,561,517 B2 10/2013 Brown
8,572,875 B2 11/2013 Sisgold
8,713,832 B2 * 5/2014 Troy ..... F41A 17/38 42/6
8,826,797 B2 9/2014 Overstreet et al.
8,984,786 B2 * 3/2015 Underwood ..... F41A 9/59 42/18
9,097,474 B1 8/2015 Zins et al.
9,541,339 B2 * 1/2017 Orne, III ..... F41A 3/72
9,557,125 B2 1/2017 Stewart et al.
9,599,419 B2 * 3/2017 McGinty ..... F41A 35/06
2005/0000138 A1 * 1/2005 Kiss ..... F41A 17/36 42/50
2005/0183310 A1 * 8/2005 Finn ..... F41A 17/38 42/49.01
2007/0006720 A1 1/2007 Liao
2010/0275485 A1 11/2010 Findlay
2011/0056107 A1 3/2011 Underwood
2011/0247483 A1 * 10/2011 Overstreet ..... F41A 9/70 89/138
2011/0252957 A1 10/2011 Overstreet et al.
2012/0167424 A1 7/2012 Gomez
2012/0174451 A1 7/2012 Overstreet et al.
2012/0180354 A1 * 7/2012 Sullivan ..... F41A 3/26 42/16
2012/0297656 A1 * 11/2012 Langevin ..... F41A 3/66 42/16
2013/0014416 A1 1/2013 Sisgold
2013/0152442 A1 6/2013 Underwood
2014/0060310 A1 3/2014 Overstreet et al.
2014/0150639 A1 * 6/2014 Sugg ..... F41A 3/68 89/193
2015/0101230 A1 * 4/2015 Curtis ..... F41A 3/66 42/75.01
2015/0198400 A1 * 7/2015 O'Dell ..... F41A 17/36 42/18
2015/0323271 A1 * 11/2015 McGinty ..... F41A 35/06 42/17
2017/0082385 A1 * 3/2017 Orne, III ..... F41A 3/72
2017/0160026 A1 * 6/2017 Walther ..... F41A 3/66

* cited by examiner

SECTION A-A

SECTION A-A

SECTION A-A

SECTION A-A

SECTION A-A

SECTION A-A

SECTION B-B

SECTION B-B

SECTION B-B

SECTION B-B

SECTION B-B

SECTION B-B

SECTION A-A

SECTION A-A

SECTION A-A

SECTION A-A

SECTION A-A

SECTION A-A

SECTION A-A

SECTION A-A

SECTION A-A

SECTION A-A

SECTION A-A

SECTION A-A

SECTION B-B

SECTION B-B

SECTION B-B

SECTION B-B

SECTION B-B

SECTION B-B

SECTION B-B

MAGAZINE AND BOLT RELEASE FOR FIREARM

FIELD OF THE INVENTION

The present invention relates to a receiver for a firearm. In particular, the present invention relates to the magazine and bolt release mechanism of a firearm.

BRIEF DESCRIPTION OF THE FIGURES

Advantages of the invention will become apparent upon reading the following detailed description and upon reference to the drawings.

DETAILED DESCRIPTION

This system applies to semi-automatic firearms in general and particularly to AR-15/AR-10 rifles, as well as all related platforms, including but not limited to M-16/M-4 Rifles. The system also applies to all caliber projectiles from said rifles, including sub-caliber and/or pistol caliber projectiles. One of ordinary skill in the art would also understand that the features of the present invention could be applied to other firearms, and particularly to any firearm utilizing a removable magazine.

Throughout this application, the directional references, such as forward, rearward, left, right, bottom and top, will be used. These and other such references are relative to the firing direction of the firearm, which fires in a forward direction. Such references are used for ease in describing the present invention and should not be construed as limiting the scope of the invention. As used in the description herein and throughout the claims, the following terms take the meanings explicitly associated herein, unless the context clearly dictates otherwise: the meaning of "a," "an," and "the" includes plural reference, the meaning of "in" includes "in" and "on." Also, reference designators shown herein in parenthesis indicate components shown in a figure other than the one in discussion.

For clarity, not all elements have been labeled in all figures. Some figures show cutaways or parts removed to simplify the figures or illustrate underlying components.

Embodiments of the present invention include an integrated magazine and bolt release mechanism that is intended to automate the operations of magazine release when empty, and bolt release when a loaded magazine is inserted into the rifle. The release mechanism eliminates the need for a shooter to count his rounds to anticipate for, or plan a preemptive or tactical reload. The release mechanism also eliminates the need for a shooter to consciously close the action after a reload to prepare for continued firing. This mechanism allows a shooter to concentrate only on aiming and firing his weapon. All that is required to continue firing, as much as reloading is concerned, is that the shooter keep his rifle supplied with a full magazine.

Figure 1:
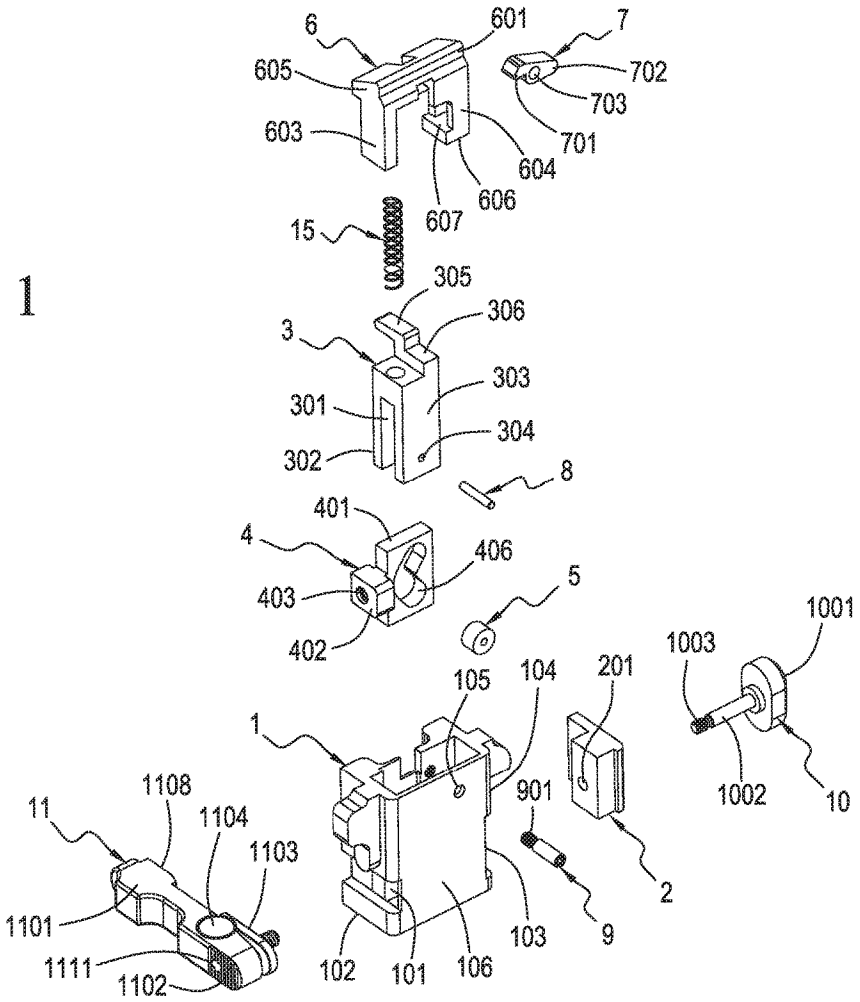
FIG. 1 is an exploded view of a magazine and bolt release mechanism in accordance with an embodiment of the invention.
Figure 2B:
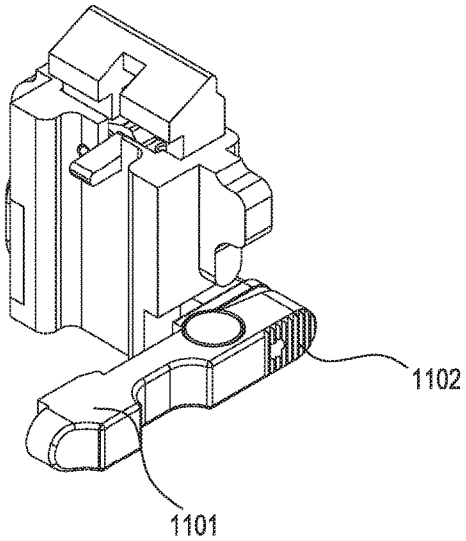
FIG. 2B is a perspective view of the magazine and bolt release mechanism of FIG. 1
Figure 2D:
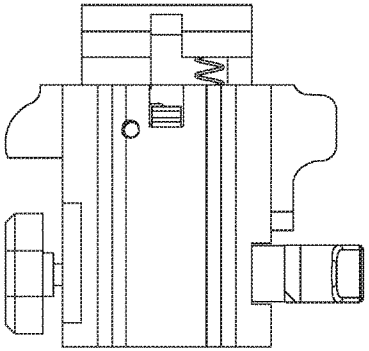
FIG. 2D is a front view of the magazine and bolt release mechanism of FIG. 1.
Figure 2A:
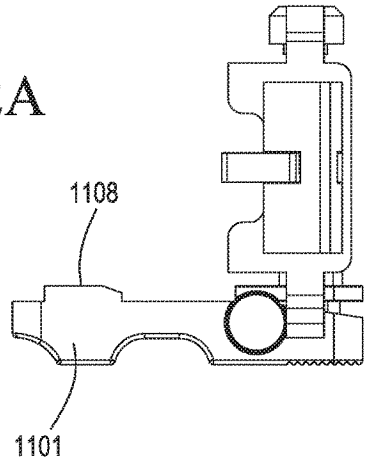
FIG. 2A is a top view of the magazine and bolt release mechanism of FIG. 1.
Figure 2C:
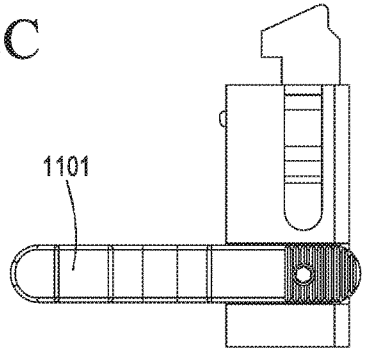
FIG. 2C is a side view of the magazine and bolt release mechanism of FIG. 1.

The lower receiver of the AR-15 pattern rifle is modified from original design and configuration to accommodate the new structure and function. Other firearms may also be appropriately modified. As illustrated in FIG. 1, the release mechanism is a pre-assembled cartridge that is housed on the main body 1. Certain embodiments of the release mechanism will allow its use in any AR-15 patterned rifle, provided the requisite modification to the lower receiver. In such embodiments, all modification to a lower receiver is internal. No external changes are required to adapt an AR-15 pattern rifle to the release mechanism. Such embodiments of the release mechanism will allow its use with any upper receiver assembly (and related components therein) intended for use on the AR-15 pattern rifle. Further embodiments of the release mechanism will allow its use and proper function with any magazine intended for use in the AR-15 patterned rifle.

Embodiments of the release mechanism make use of an ambidextrous magazine catch release 11 as the operative component used to retain the magazine. Examples of an ambidextrous magazine catch may include, but are not limited to, the NORGON Ambi-Catch™. An ambidextrous magazine release in accordance with embodiments of the invention may have a design that allows it to pivot in a limited range on a horizontal plane. This pivoting allows the insertion of a magazine without imparting motion to the release mechanism. This feature also allows removal of a magazine, by activation of the pivoting lever only. Magazine removal is effected without imparting motion to the release mechanism. Embodiments of the release mechanism eliminate the common magazine release button from the right side of the rifle.

In their default operation, embodiments of the release mechanism tend to lock the bolt group to the rear. This function is deactivated by the presence of ammunition in an affixed magazine. Embodiments of the release mechanism will not retain an empty magazine, and further embodiments of the release mechanism will not allow the bolt to be released into battery on an empty magazine.

The release mechanism operates using different surfaces of the magazine body for its operation. The body of the magazine itself, when present, is responsible for causing the bolt to "auto-drop". The follower, when present in its uppermost position of an empty magazine, is responsible for activating the magazine drop.

The release mechanism features adjustment to the location and duration of its cycle to accommodate magazines manufactured to varying specification. This consists of spacer washers of varying thickness. For example, AR-15 magazines are made to a standard fit only according to the common operating surfaces; that are requisite to the intended function of the original, AR-15 pattern rifle. The release mechanism utilizes some surfaces on the magazine that are not held to a standard specification; these areas have been assumed to be non-critical and are designed and manufactured to an arbitrary dimension or finish. Therefore, the release mechanism is designed to be adjusted to allow the use of any brand or design of magazine, including for example, any brand or design that is intended for use in the AR-15 pattern rifle.

Embodiments of the release mechanism include a mechanical switch device. The mechanical switch device may be linkage having a lever 3 that is able to identify the presence of ammunition. By way of mechanical linkage, the system is able to control the magazine catch surface to either maintain or expel a magazine. This switch device is composed of the lever 3 and a roller bearing, arm bearing 5, that impinges against and traverses through a chevron or kidney shaped pathway in a bottom arm 4. This bearing and its pathway facilitate the transition of vertical motion, imparted by the magazine body and follower to the lever 3 into horizontal motion of the bottom arm 4 to move the magazine catch in and out of engagement with the magazine's locking surface.

Upward vertical motion of the lever 3 actuates the bolt catch 6 surface by means of a mechanical link, top arm 7, that serves to reverse the direction of vertical motion. As the magazine body moves upward, the lever 3 impinges on the top arm 7 forcing the bolt catch downward, to release the locked bolt group.

The basic functional sequence of certain embodiments may be as follows: 1) the rifle's bolt should be locked rearward. Initially, this may be performed manually. 2) A loaded magazine is inserted into the rifle. If the magazine is appropriate, and is loaded with a minimum of 2 rounds of ammunition, the bolt (now locked rearward) will automatically be released and start forward into battery position, and strip a live round from the magazine while on that path of travel. The rifle is fired and operated as usual until 3) the round count in the magazine becomes 1. Thereafter, 4) upon stripping the last live round from the magazine, the release mechanism will detect that the magazine is empty, and release that magazine. 5) When the last round is fired from the rifle, the bolt will reciprocate through its path of travel, and become locked in the open position. When a new magazine is inserted, the bolt is automatically released, and the process is repeated. The features and operation of this and other embodiments are described in more detail below.

FIG. 1 shows an exploded perspective view of the release mechanism. Components of the release mechanism include the release mechanism main body 1. Magazine catch 11 may comprise a catch arm 1101. The catch arm 1101 may be pivotally connected with a base 1103 by a pin 1104 that extends through a pivot boss 1105. The catch arm may include a serrated or otherwise textured depression surface 1102 on a portion of the catch arm rearward of the pivot boss. The catch arm 1101 may further include a forward boss 1107. The forward boss may include an engagement tooth 1108 extending from an inward surface of the catch arm adjacent to the magazine. The magazine catch may include a spring or other biasing mechanism that tend to rotate the catch arm such that the engagement tooth is pressed inwardly. The magazine catch 11 may be configured such that depressing the depression surface 1102 causes the catch arm 1101 to rotate about pin 1104 and move the forward boss 1107 outwardly away from the magazine.

Figure 6:
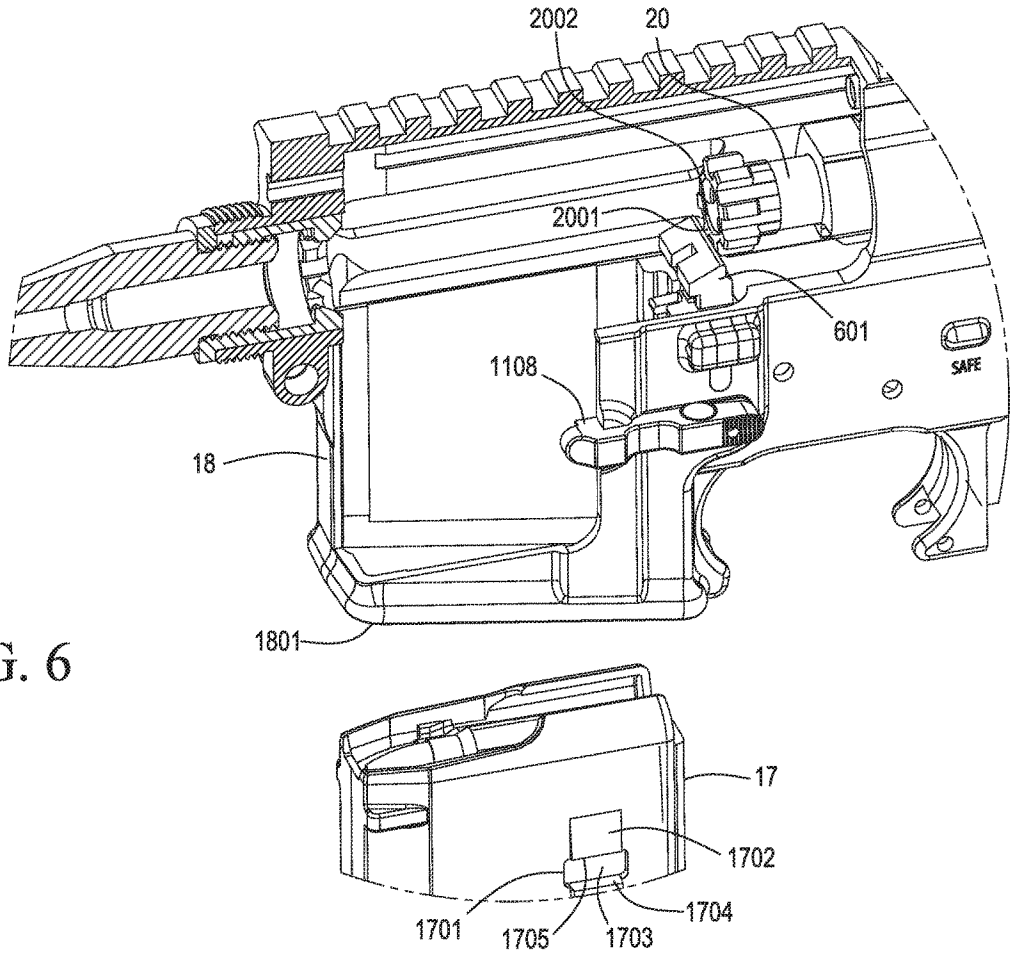
FIGS. 6-11 are partially cut-away perspective views of an embodiment of the present invention showing various steps of a loading and firing cycle, including: prior to magazine insertion (6); magazine insertion and release of the bolt (7); the bolt moved forward to its "battery" position (8); the bolt in a rearward position (9); the magazine released upon chambering of the final round in the magazine (10); and the bolt held in a rearward position after firing of the final round (11).
Figure 7:
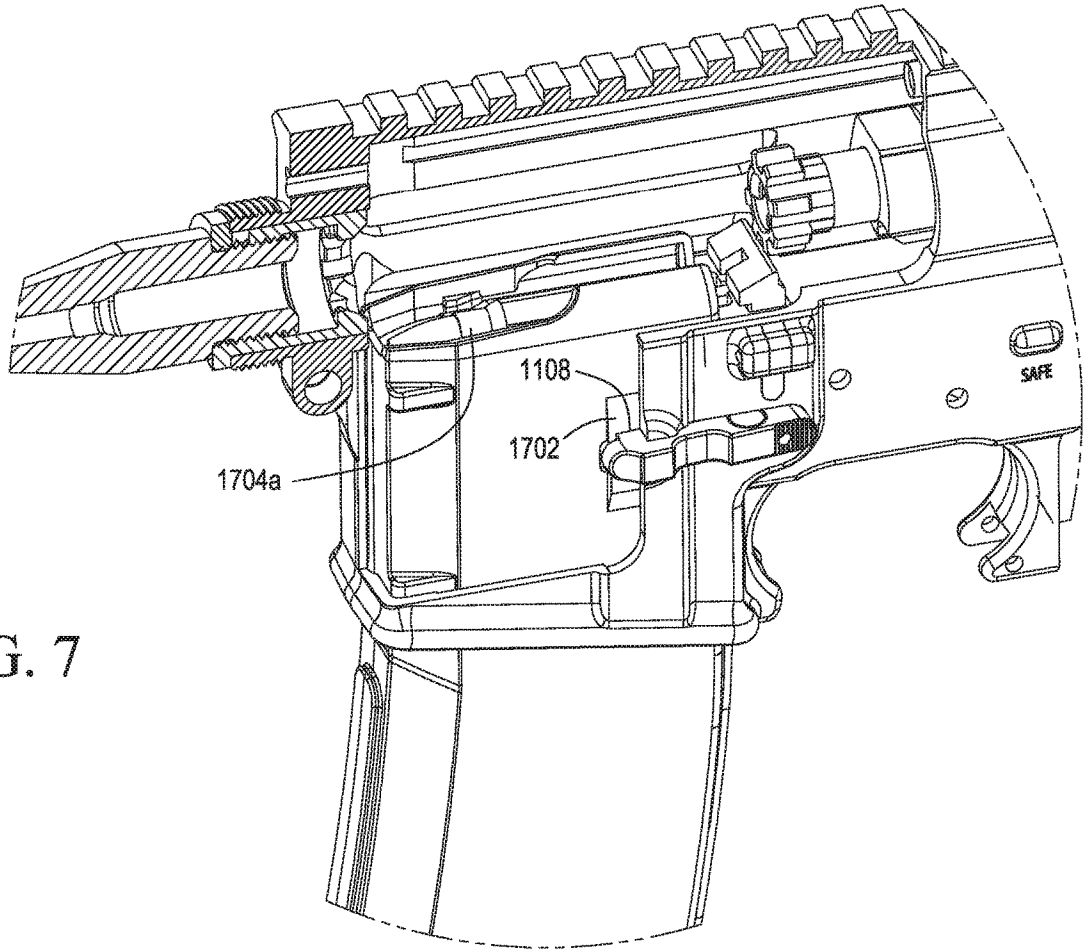
Figure 8:
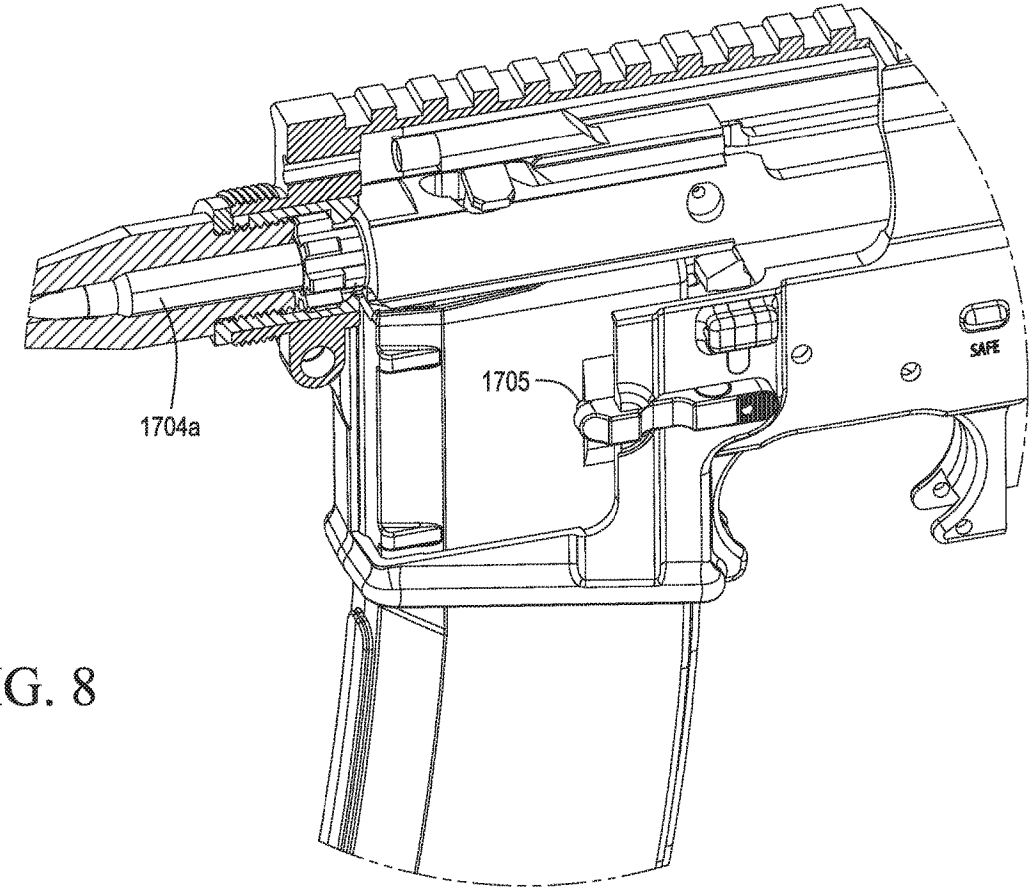

As illustrated in FIGS. 6-8, the magazine 17 may include a locking element 1701. The locking element may include a ramped surface 1702 and an engagement slot 1703. The ramped surface may form an upper step 1705 at a lower end of the ramp. The locking element may also include a lower step 1704 below the slot 1703.

According to such embodiments, as the magazine 17 is inserted into the magazine well 1801 of the lower receiver 18, the engagement tooth 1108 slides along the angle's surface of ramp 1702, pushing the engagement tooth away from the side surface of the magazine and rotating the catch arm 1101 against the rotational bias. Once the magazine has been completely inserted into the magazine well, the engagement tooth passes beyond the lower end of the ramp 1702. The catch arm rotates inwardly, and the engagement tooth 1108 engages the slot 1703. Once the engagement of the tooth 1108 is captured in slot 1703, the upper and lower steps (1705, 1704) prevent the magazine from moving farther up or being released downwardly as long as the tooth engages the slot. If the catch arm 1101 is rotated outwardly against its biased rotation, such as by manual actuation of the shooter, the engagement tooth 1108 will disengage from the slot 1703 and the magazine 17 may be pulled from the magazine well 1801. The magazine may be pulled from the well by an action of the shooter or by the force of gravity acting on the magazine.

A shaft 1106 may extend through a portion of the magazine catch base 1103 rearward of the pin 1104. The shaft may include threads 1109 that engage with other components of the release mechanism to secure the magazine catch to the mechanism. The threaded shaft 1106 may comprise a screw 1110 (FIG. 12B), and a hole 1111 may extend through the depression surface 1102 to allow access to the head of the screw.

Figure 5:
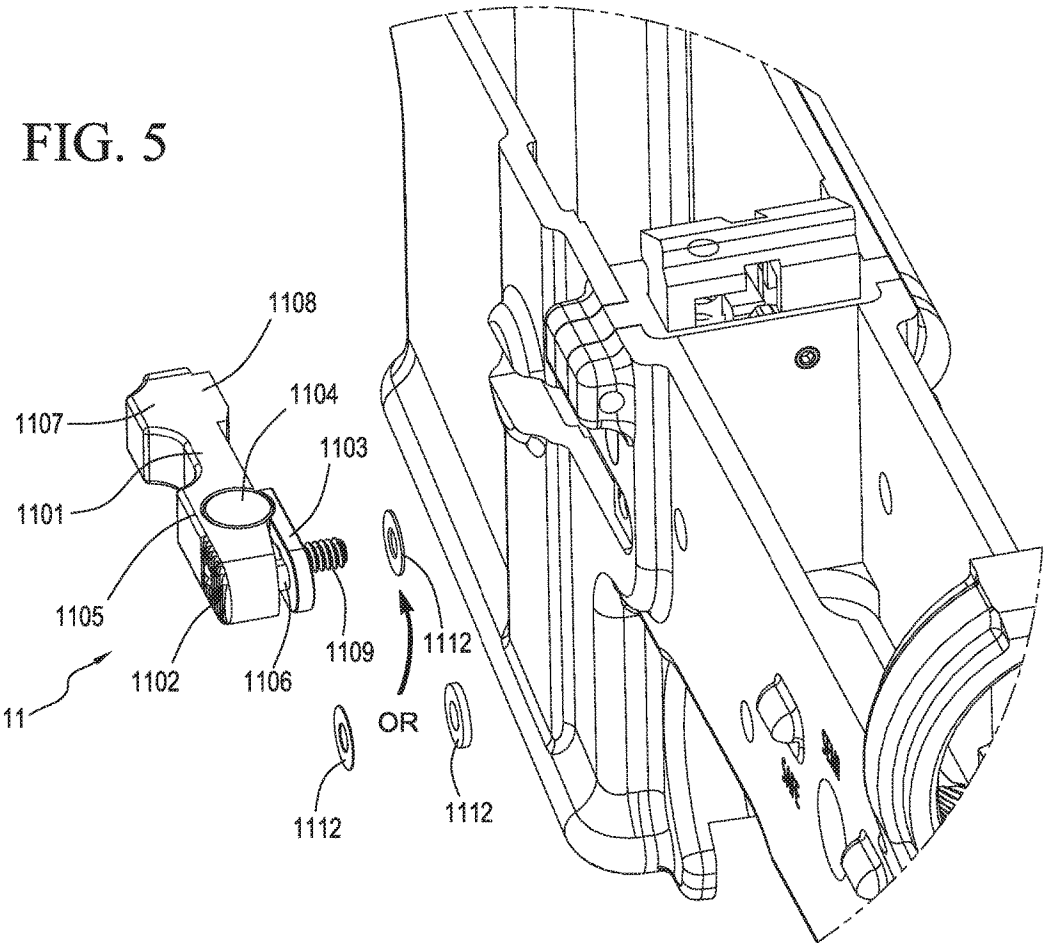
FIG. 5 shows a firearm lower receiver and ambidextrous magazine catch with a spacer washer of various thicknesses.
Figure 12B:
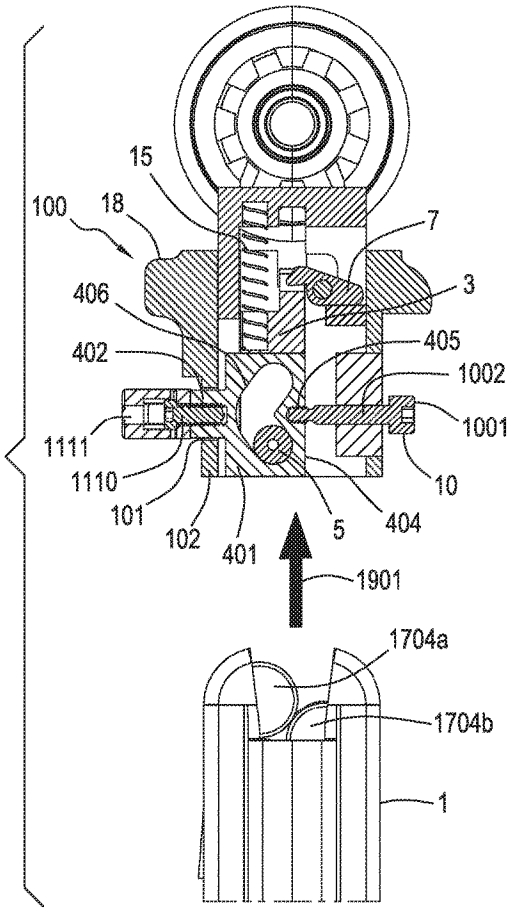
FIGS. 12A-17B are top and laterally cross-sectional views of an embodiment of the present invention showing various steps of a loading and firing cycle.

As illustrated in, for example, FIGS. 1 and 12B, a bottom arm 4 may have a guide path portion 401 that is positioned within an internal cavity of the release mechanism body 1. The bottom arm 4 may also include an attachment boss 402 that protrudes through a slot 101 formed in a left side 102 of the release mechanism body 1. The base 1103 of the magazine catch 11 may be attached by screw 1110 to the attachment boss 402 of bottom arm 4. The attachment boss 402 may include a threaded hole 403 for securing the screw 1110 or may include some other means of attaching the magazine catch to the attachment boss. Spacing of the magazine catch 11 relative to the bottom arm 4 may be adjusted by placement of various size washers 1112 around shaft 1106 between an inside/right surface of the base 1103 and the outside/left surface of the bottom arm attachment boss 402 (see FIG. 5).

In embodiments of the release mechanism, the bottom arm 4 may move transversely from side to side. In the illustrative embodiments (see FIGS. 12-17), as the bottom arm is moved toward the left side of the firearm, it moves the entire magazine catch 11 leftward. This leftward movement disengages the engagement tooth 1108 out of engagement with the magazine slot 1703, allowing release of the magazine. Accordingly, the magazine may be release by manual, rotational actuation of the catch arm 1101 or by translation of the entire magazine catch 11 by movement of the attached bottom arm 4.

Figure 3:
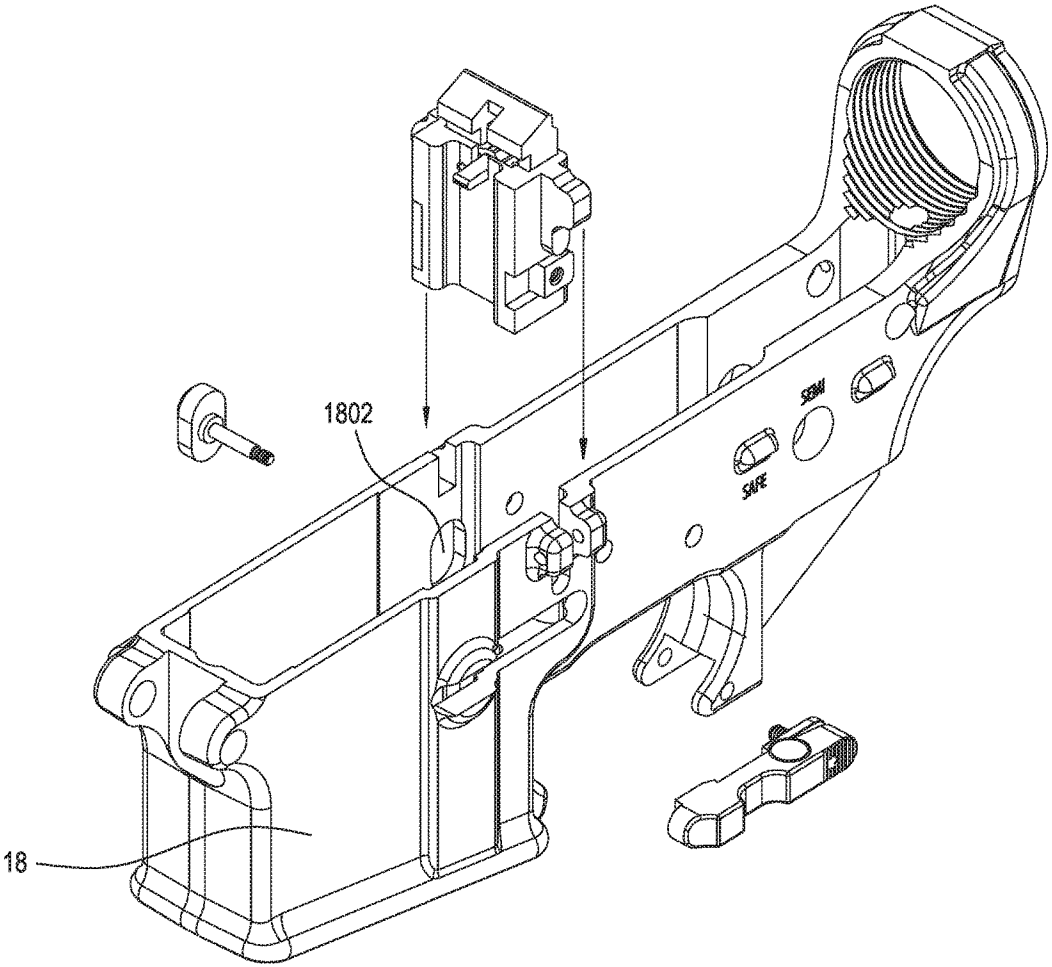
FIG. 3 is a perspective view of a firearm lower receiver showing its relationship to embodiments of a magazine and bolt release mechanism and an ambidextrous magazine catch.
Figure 4A:
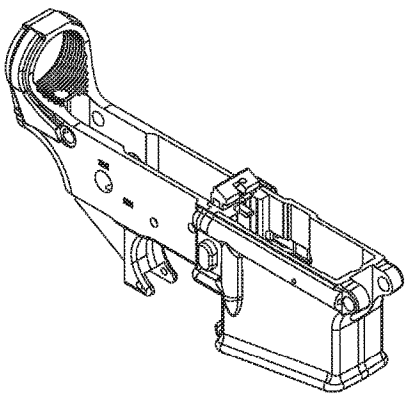
FIGS. 4A-F are various views of the firearm lower receiver with an installed magazine and bolt release mechanism and an ambidextrous magazine catch.
Figure 4B:
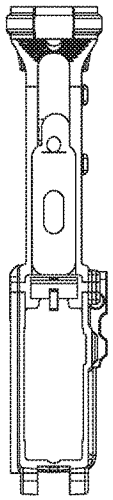
Figure 4C:
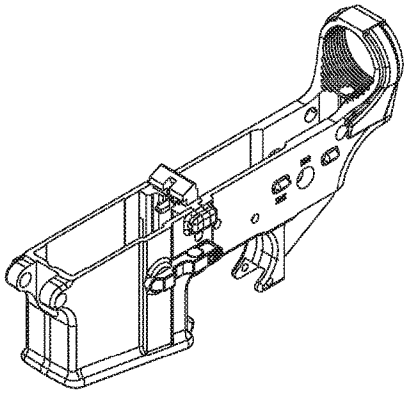
Figure 4D:
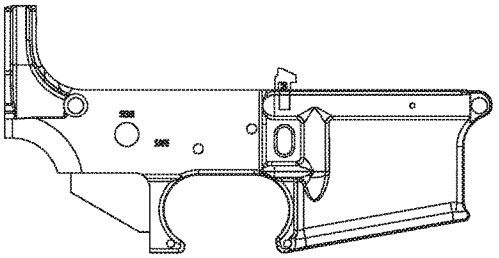
Figure 4E:
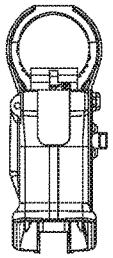
Figure 4F:
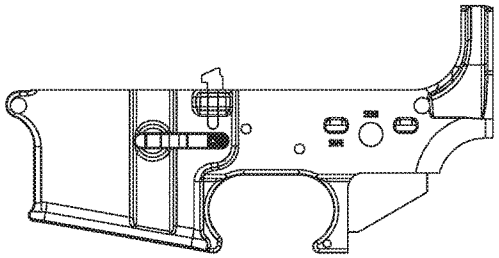

As illustrated in FIG. 12B, the release mechanism may also include a catch button 10 on a right side of the firearm. The catch may have a serrated or otherwise textured surface 1001. The catch button may also include a shaft 1002 extending from the catch button opposite the textured surface. This shaft may engage a side 404 of the bottom arm opposite the attachment boss 402. The shaft 1002 may comprise a screw having threads 1003 adapted to engage corresponding threaded hole 405 formed in the side 404 of the bottom arm. The catch button extends through a hole 1802 formed in the right side of the lower receiver 18 (FIG. 3). The shaft 1002 of the catch button may extend through a hole 201 formed through a body insert 2 that is positioned in an aperture 103 in a right side 104 of the release mechanism body 1. In certain embodiments, depression of the catch button 10 by the shooter causes the bottom arm 4 to move toward the left side of the release mechanism body 1 and correspondingly translates the magazine catch 11 to disengage the tooth 1108 from the magazine slot 1703.

Movement of the bottom arm 4 and corresponding movement of the magazine catch 11 may also be effected by operation of the magazine 11 as described below, referring primarily to FIGS. 1 and 12-17. The release mechanism may comprise a lever 3. The lever may include a transverse slot 301 formed in a lower portion of the level. The transverse slot may form front 302 and back 303 sidewalls. These sidewalls may include holes 304 that are aligned and extend parallel to the firearm axis. A bearing pin 8 may be positioned through these holes such that it extends across slot 301. An arm bearing 5 may be positioned on the pin 8 within slot 301.

The bottom arm guide path portion 401 includes a chevron or kidney shaped pathway 406. The guide path portion is positioned within the slot 301 of the lever 3 such that the arm bearing 5 is positioned within the pathway 406. In embodiments of the release mechanism, the lever 3 moves up and down in a vertical path such that the slot 301 of the lever moves with respect to the guide path portion 401. The pathway 406 and arm bearing 5 may be sized such that the bearing travels within the pathway to effect movement of the bottom arm 4 in a left to right direction as the lever 3 moves in an up and down direction.

Figure 12A:
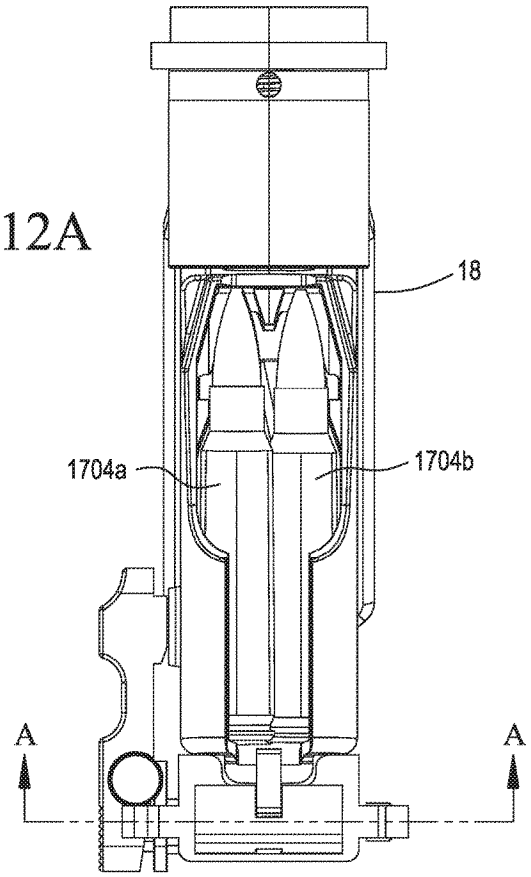
Figure 13B:
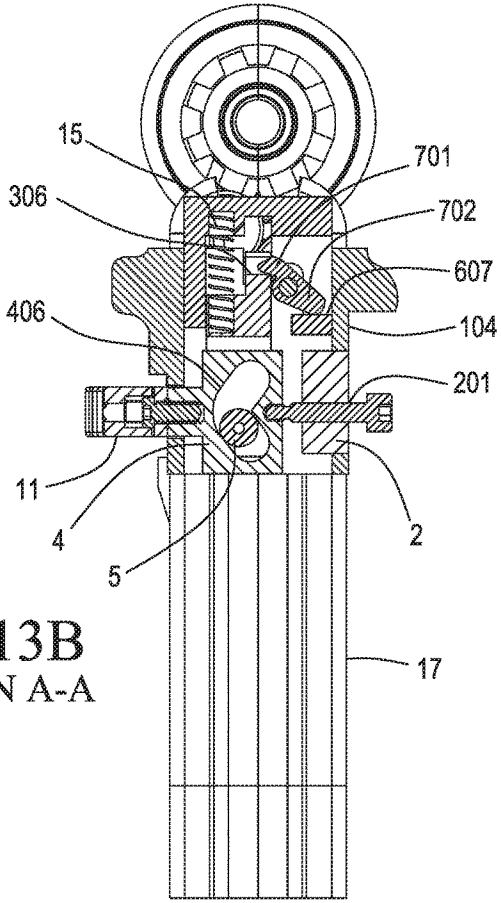
Figure 13A:
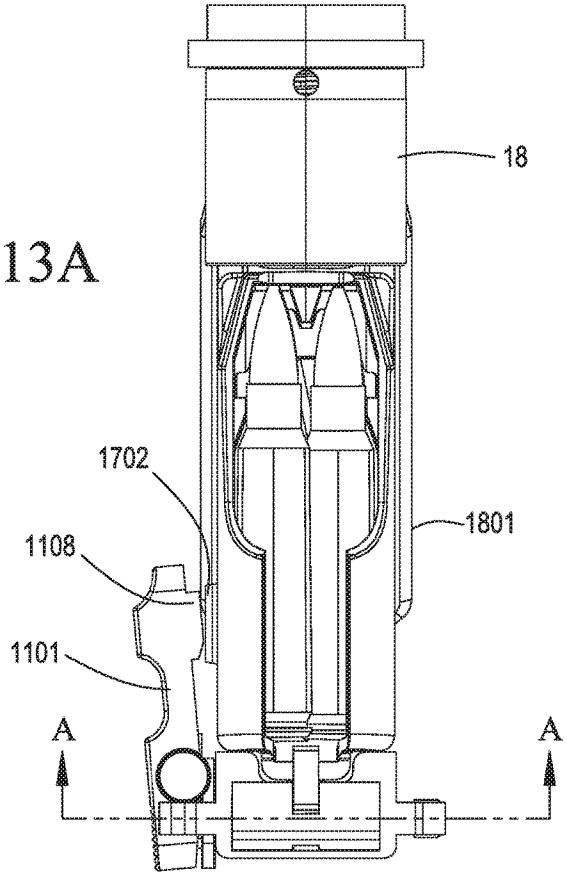
Figure 14B:
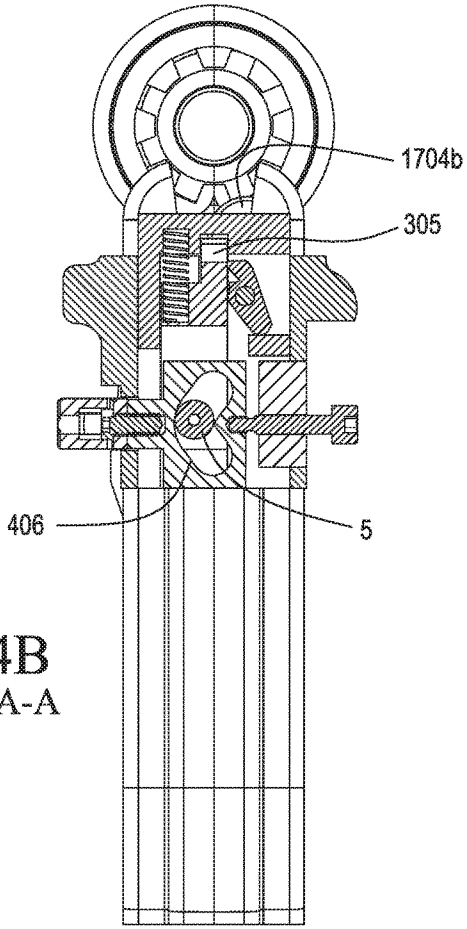
Figure 14A:
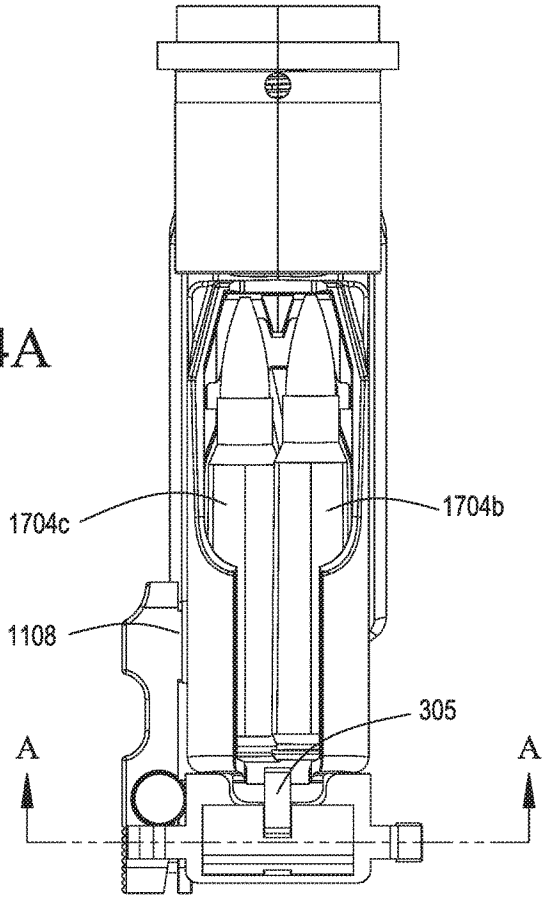
Figure 15B:
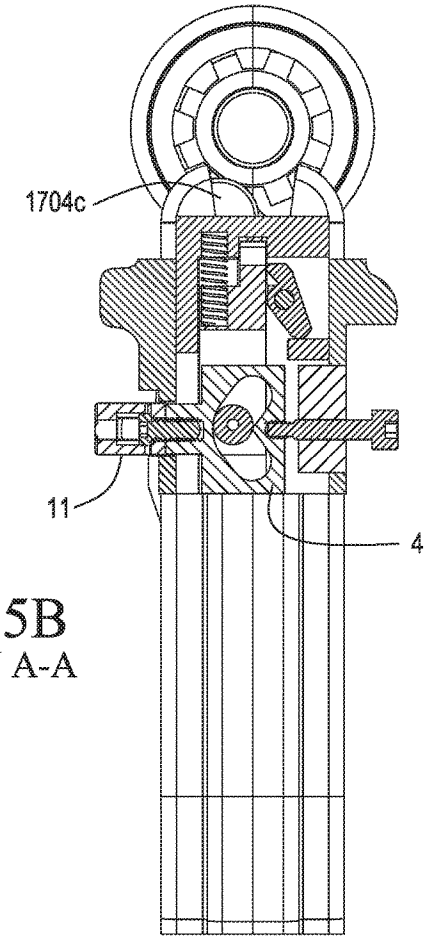
Figure 15A:
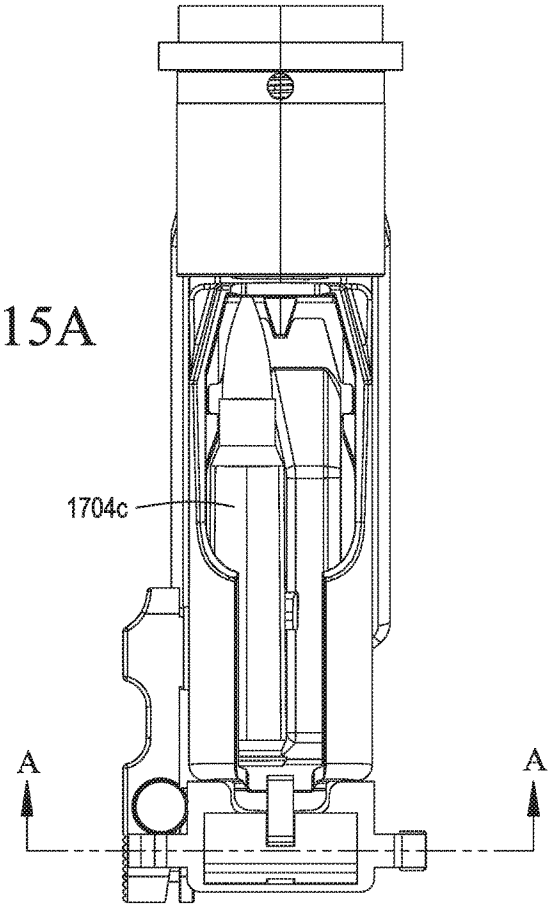
Figure 16B:
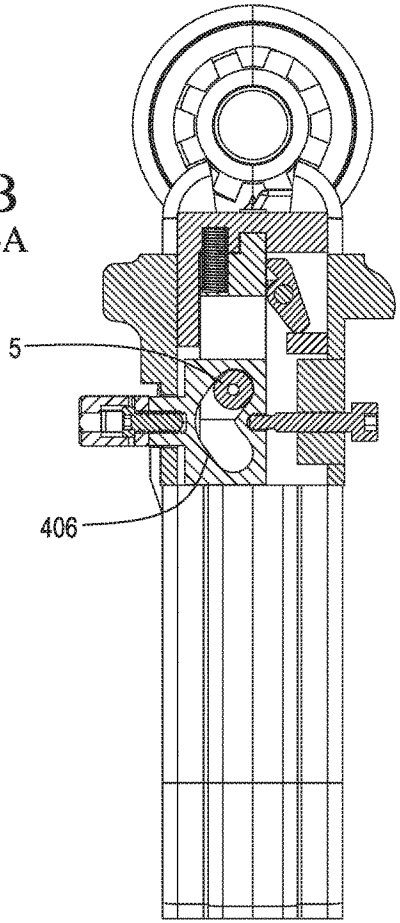
Figure 16A:
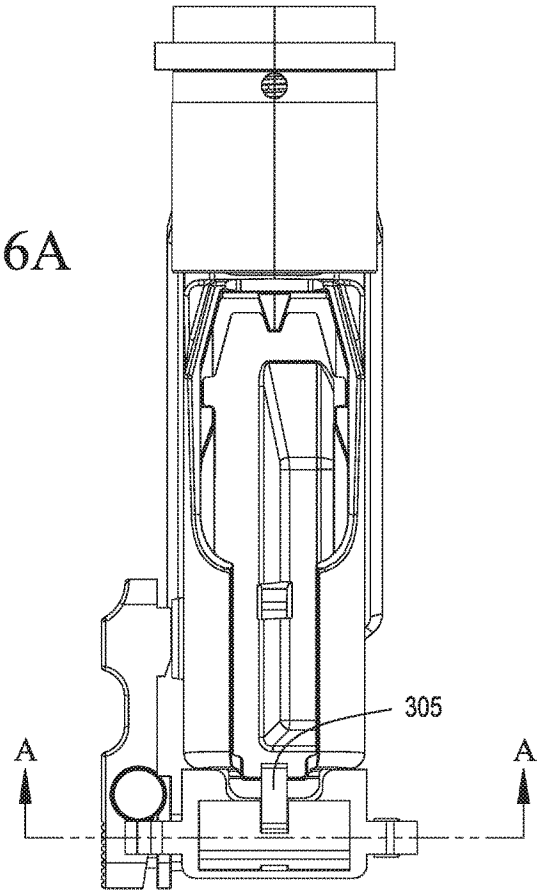
Figure 17B:
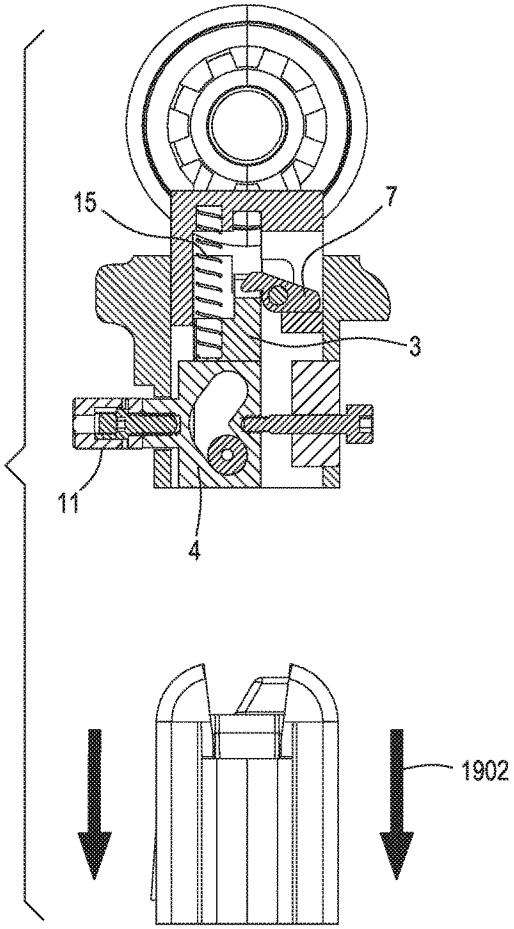
Figure 17A:
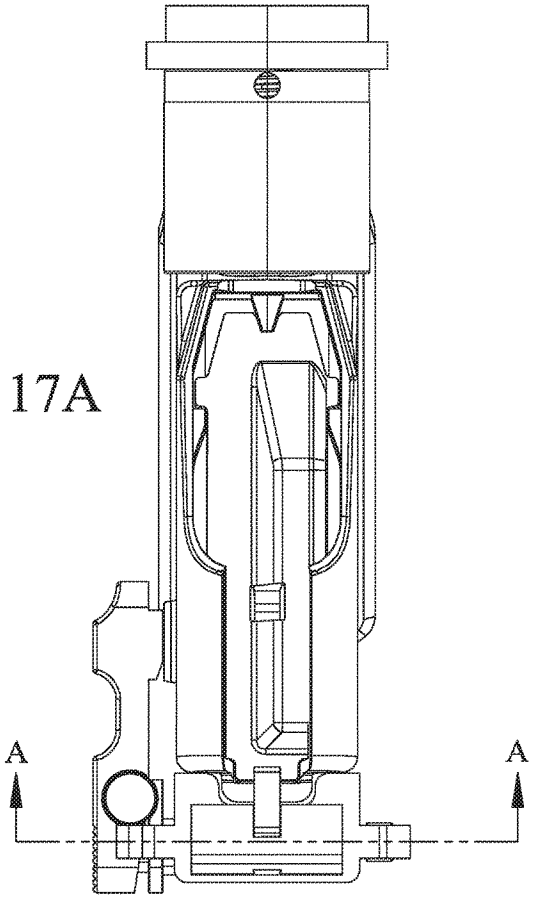
Figure 18A:
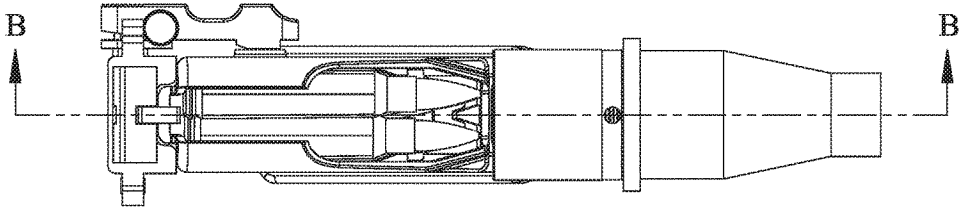
FIGS. 18A-23B are top and longitudinally cross-sectional views of an embodiment of the present invention showing various steps of a loading and firing cycle.
Figure 18B:
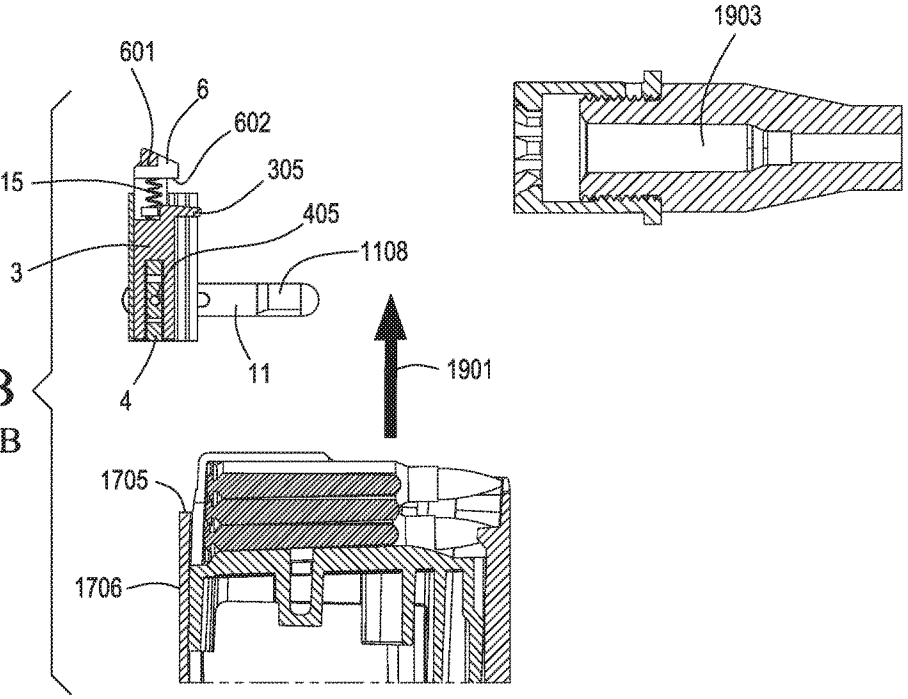

FIGS. 12A-B and 18A-B show an embodiment of the release mechanism 100 before the magazine 18 is inserted in into the lower receiver 18. FIG. 12B is a cross-sectional view along section A-A of FIG. 12A, and FIG. 18B is a cross-sectional view along section B-B of FIG. 18A. The magazine 17, including rounds 1704 will be inserted into the lower receiver 18 in the directions shown by arrow 1901. As can be seen in FIG. 12B, the lever 3 is at the lowest point of its vertical stroke with the arm bearing 5 positioned at a lower end of the bottom arm pathway 406. Accordingly, the bottom arm 4, magazine release 11 and catch button 10 are positioned at their left most positions. The release mechanism may include a spring 15 that biases the lever in a downward direction.

Figure 19A:
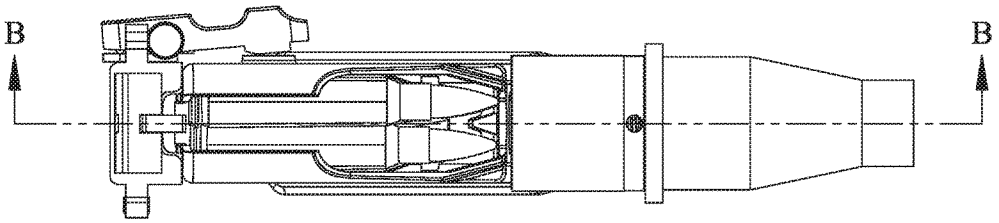
Figure 19B:
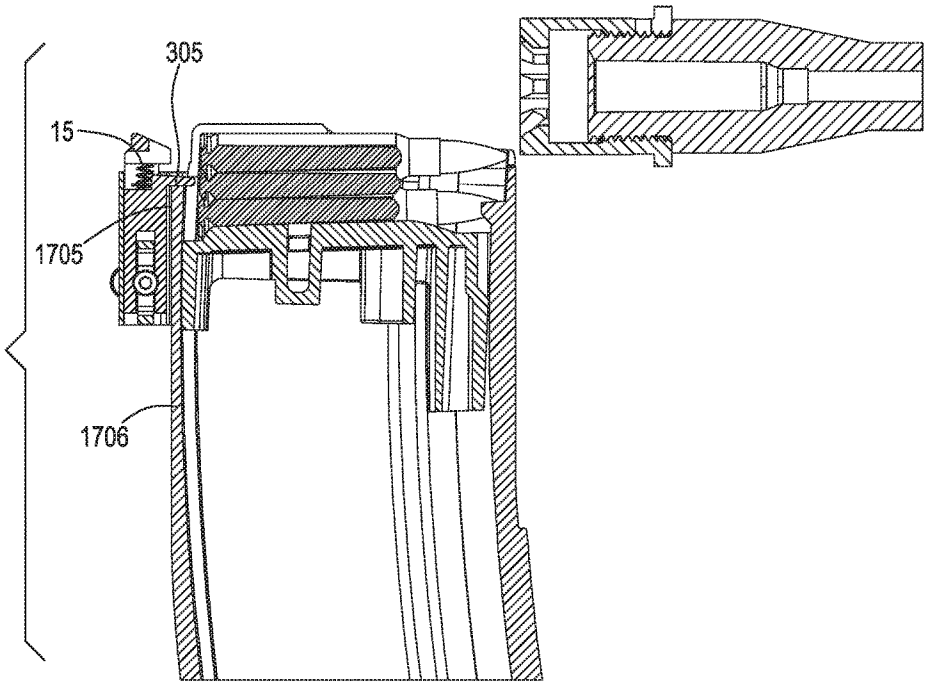
Figures 20A, 20B:
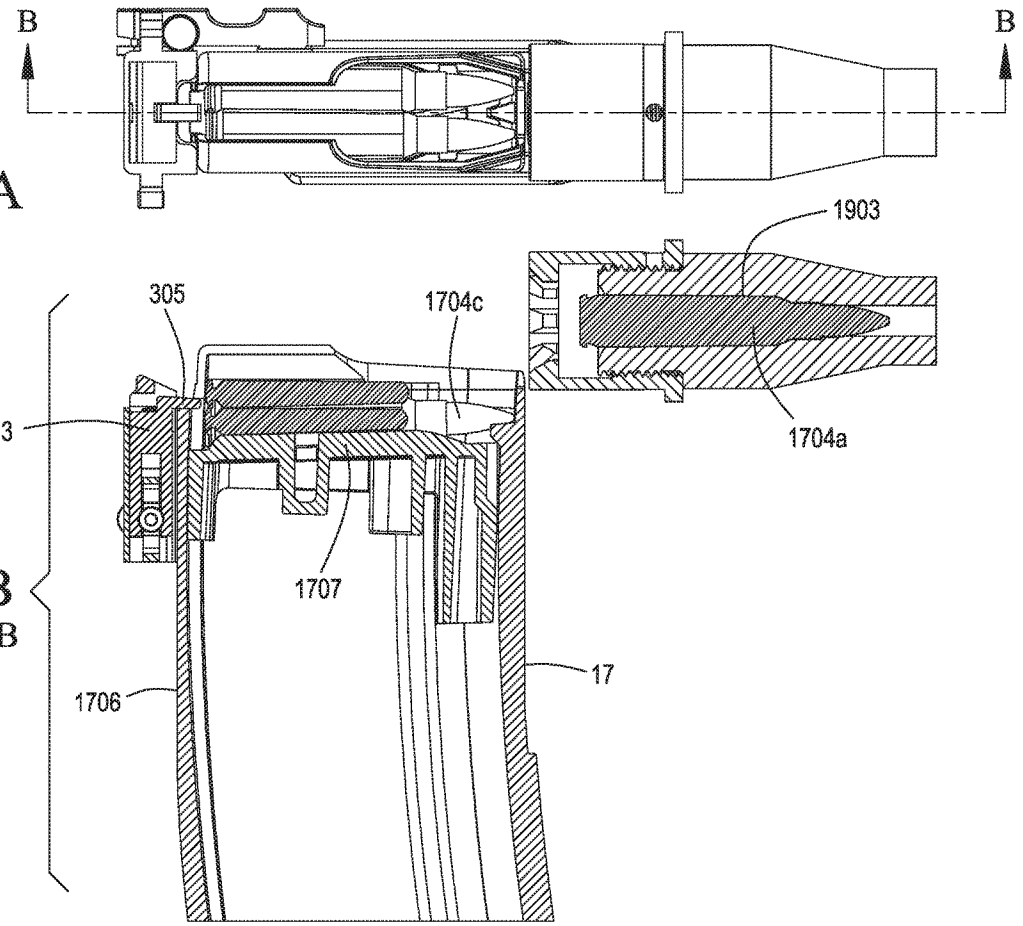
Figure 21A:
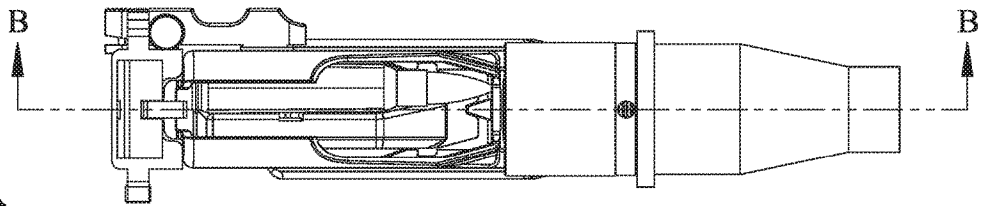
Figure 21B:
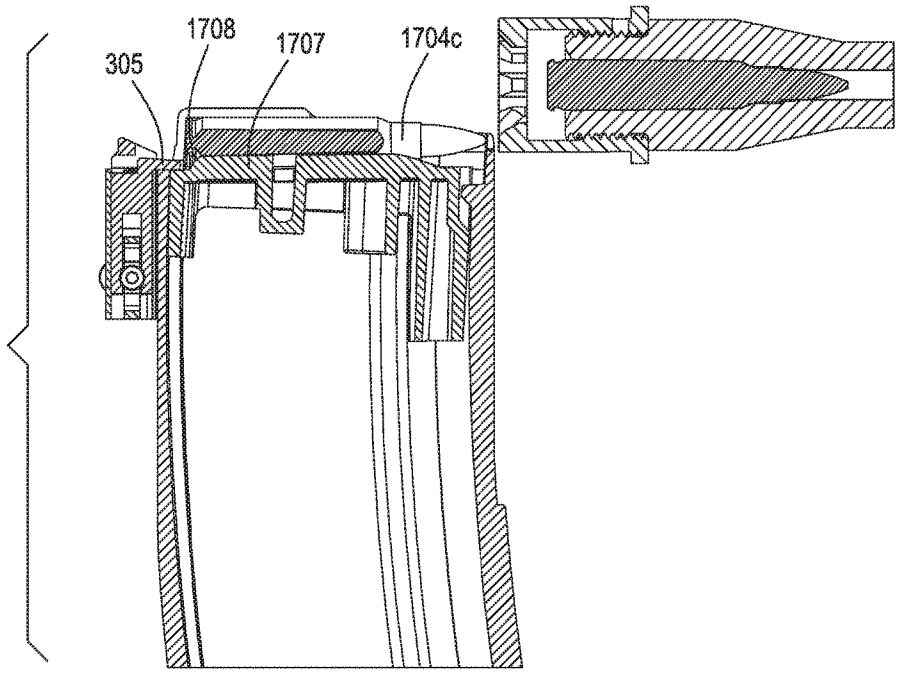
Figure 22A:
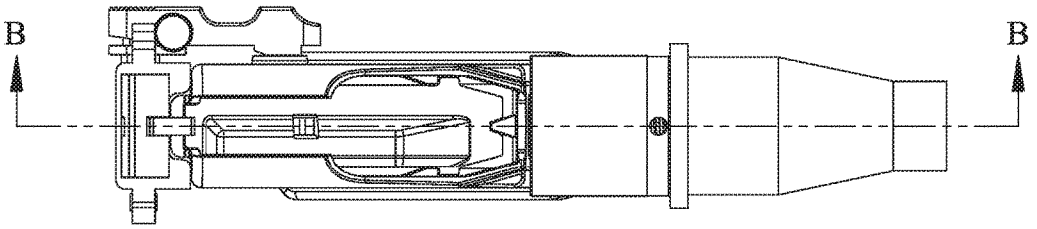
Figure 22B:
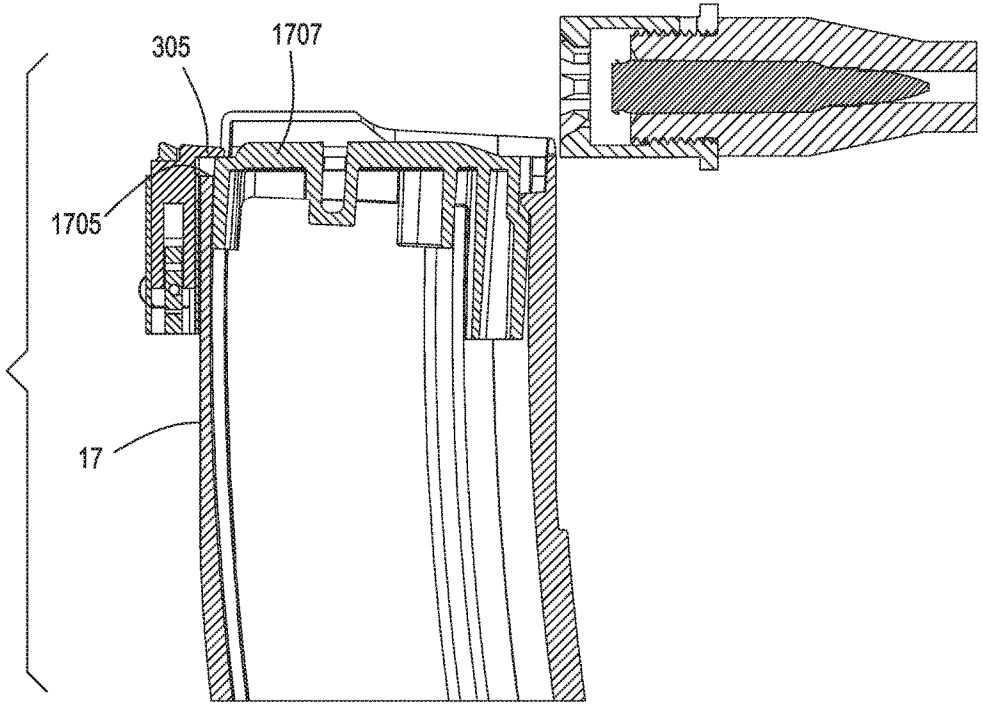
Figure 23A:
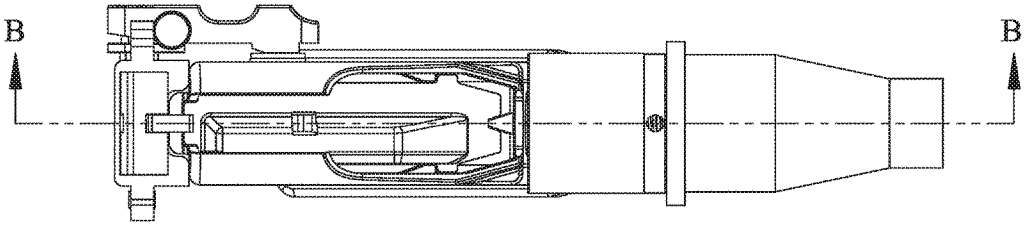
Figure 23B:
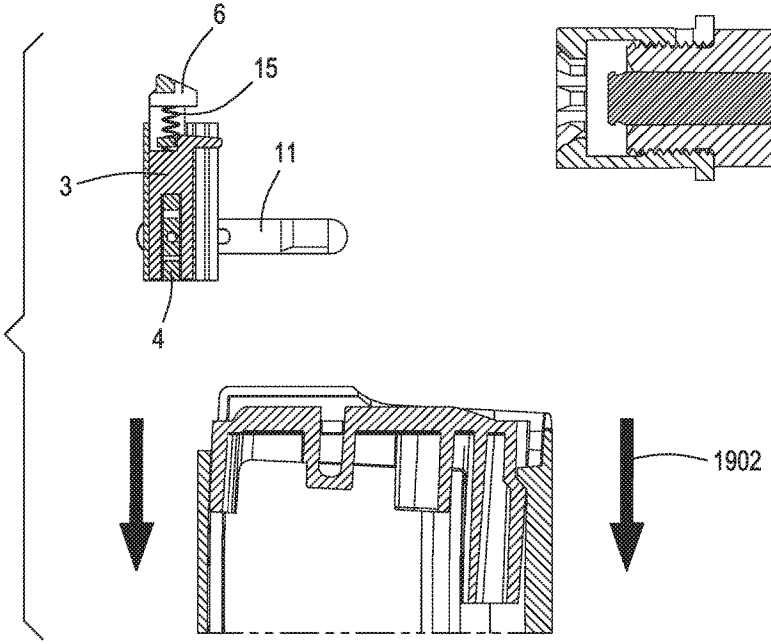

As shown in FIGS. 13A-B and 19A-B, as the magazine 17 is inserted into the magazine well 1801 of the lower receiver 18, a top edge 1705 of the magazine rear wall 1706 comes in contact with a tab 305 extending forward from a top edge of the lever 3 (see FIGS. 18-19). As the magazine continues into the magazine well, the top edge 1705 of the magazine rear wall 1706 pushes upwardly on the tab 305 driving the lever upward. The upward motion of the lever 3 moves the arm bearing upwardly in the pathway 406. This causes the bottom arm 4 and magazine catch 11 to move to the right. At the same time, the ramped surface 1702 of the magazine engages with the tooth 1108 of the magazine catch rotating the catch arm 1101 outwardly.

As shown in FIGS. 14A-B and 20A-B, as the magazine continues to move upwardly, contact with the lever tab continues to drive the lever upwardly until the magazine is fully inserted. At the point the magazine is fully inserted, the arm bearing 5 has traveled in the pathway 406 such that it is at a central portion of the pathway. At this point, the tooth 1108 passes a lower edge of the ramped surface 1702, and the tooth engages the slot 1702 of the magazine 17, securing the magazine in place. The firearm is now is condition for firing, and FIGS. 15A-B and 21A-B show the position of the components after rounds 1704*a* and 1704*b* have been fire but round 1704*c* remains in the magazine. The magazine retention apparatus, including the magazine catch 11 and bottom arm 4 will remain in this position until the last round 1704*c* is loaded into the chamber of the firearm.

FIGS. 16A-B and 22A-B show the position of the components after the final round has been stripped from the magazine. As the final round 1704*c* is stripped, the magazine follower 1707 continues to move upwardly above the top edge 1705 of the magazine rear wall 1706. A step 1708 in a rear edge of the follower 1707 engages with the tab 303 of the lever 3, driving the lever a distance above the top edge 1706 of the magazine rear wall 1706. This additional upward movement caused by the magazine follower moves the arm bearing 5 to a upper portion of the pathway 406, moving the bottom arm 4 and the magazine catch 11 back to a leftward position. As the magazine catch moves leftward, the tooth 1108 disengages from the magazine slot 1703.

As illustrated in FIGS. 17A-B and 23A-B, the magazine is freed to drop from the magazine well without any further actuation by the shooter. As the empty magazine 17 is released and drops in the direction shown by arrows 1902, the components, including the lever 3, bottom arm 4 and magazine catch 11, return to their initial positions. The process can then be repeated by inserting a loaded magazine.

In addition to controlling retention and release of the magazine, the release mechanism also effects rearward locking and release of the bolt. As shown in FIG. 6, the bolt 20 is initially maintained in a rearward, locked position. At this stage, the bolt catch 6 is in its upper position. In this position, the bolt catch holds the bolt in a rearward position by engagement of a lower edge 2001 of the bolt face 2002 with a step 601 formed adjacent an upper edge of the bolt catch.

Figure 9:
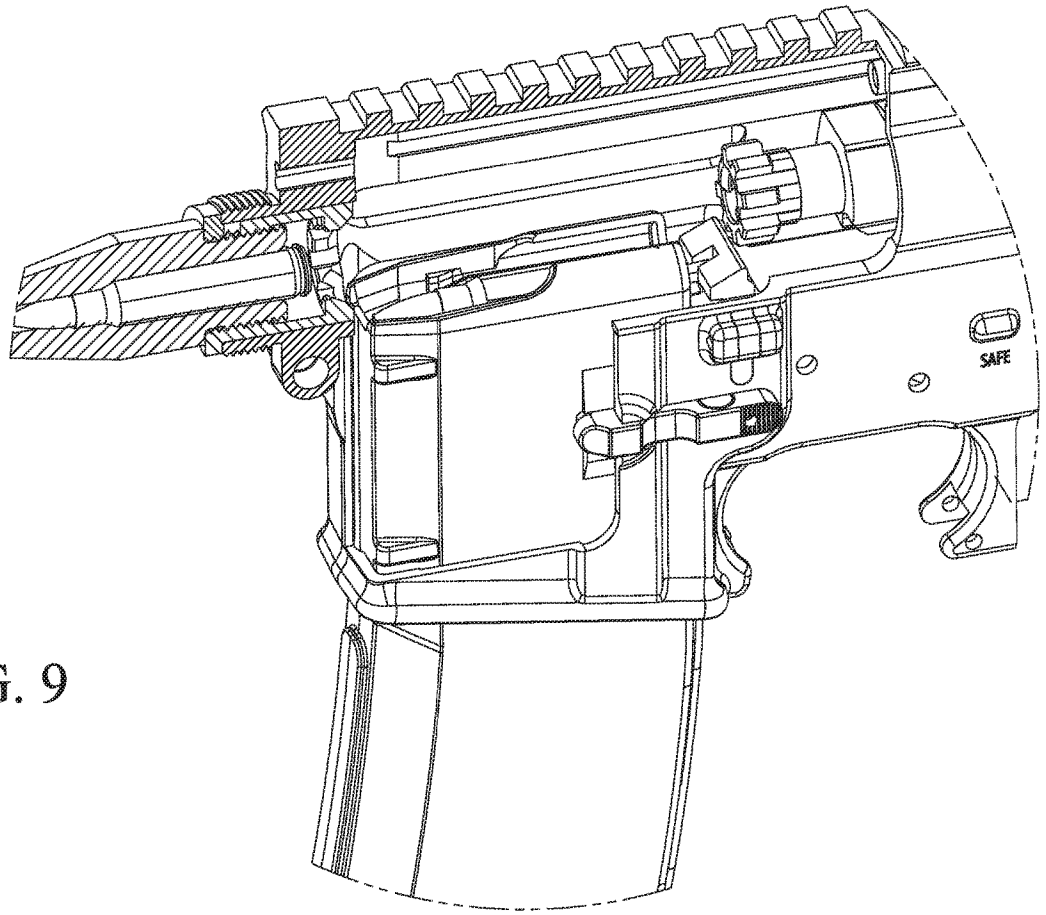
Figure 10:
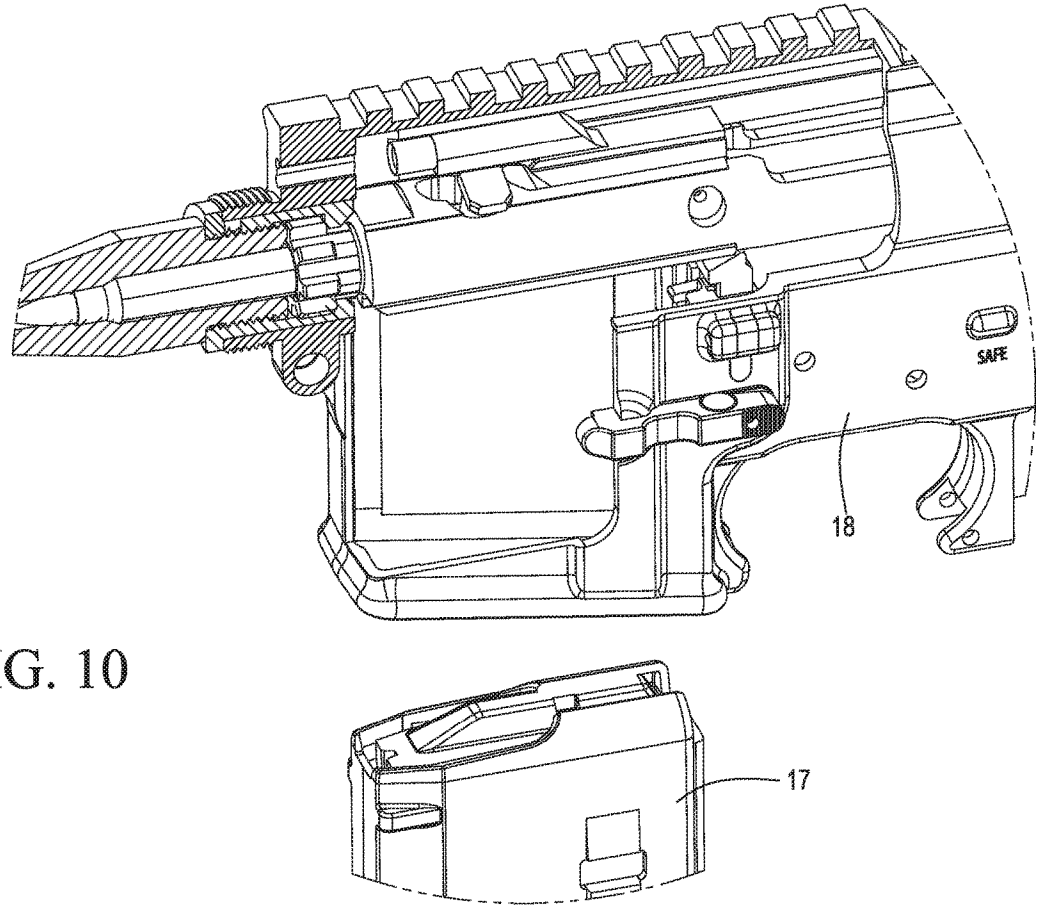
Figure 11:
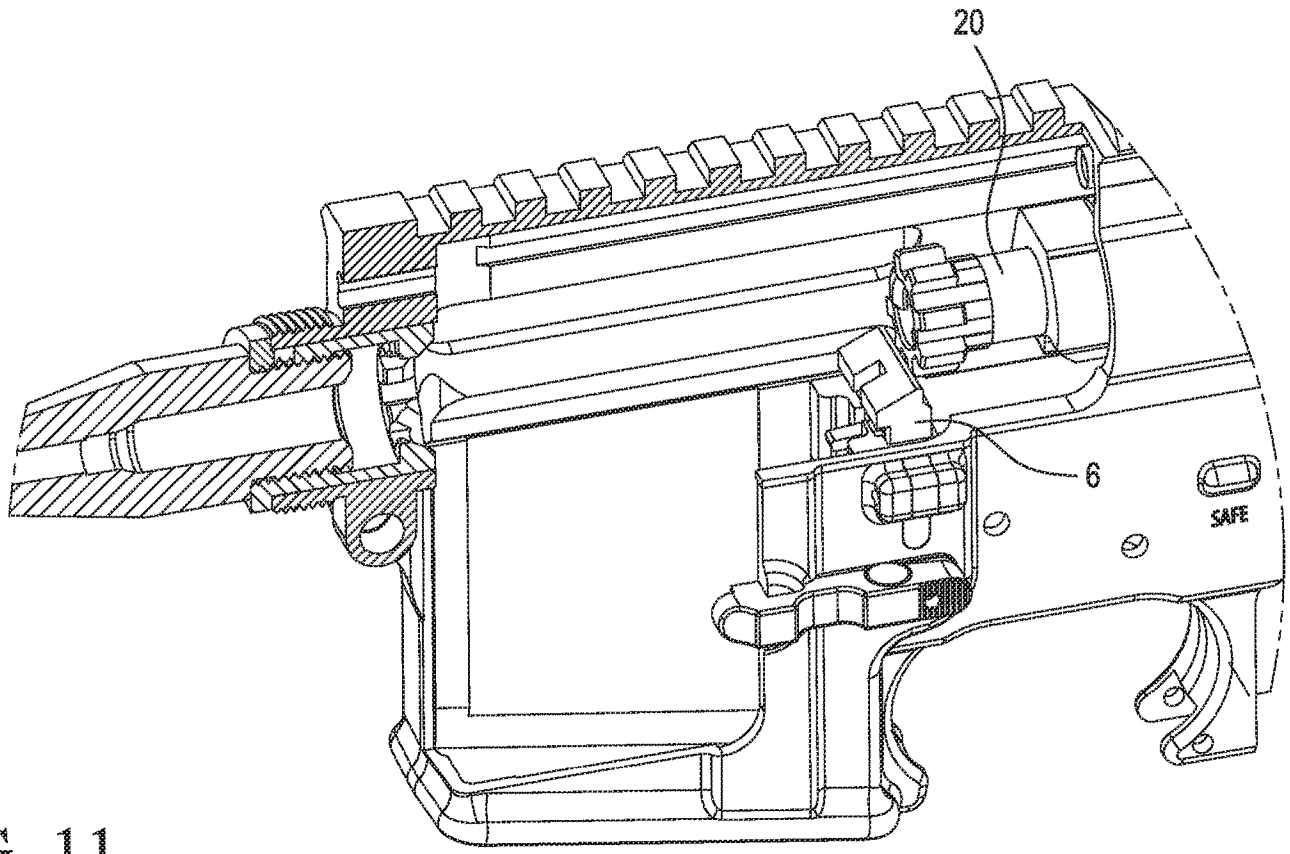

As shown in FIGS. 7-8, and as will be described in more detail herein, as the bolt catch is driven downward, the step 601 moves off the face 202 of the bolt, eventually disengaging and allowing the bolt to strip a round 1704*a* from the magazine and move into a firing position. The bolt may then actuate as the firearm is fired in a typical manner (see FIG. 9). As illustrated by FIG. 10, when the last round 1704*c* is stripped from the magazine, the magazine falls from the lower receiver as described above. When the last round is fired, the bolt is captured in a rearward, locked position by the bolt catch 6 until another magazine is inserted (see FIG. 11).

In embodiments of the release mechanism, insertion of the magazine serves to automatically release the bolt until the magazine drops from the receiver and the bolt is locked in a rearward position. This action is effected by operation of the lever 3 in conjunction with the bolt catch 6 and other components.

FIGS. 12A-B and 18A-B show an embodiment of the release mechanism 100 before the magazine 18 is inserted in into the lower receiver 18. The lever 3 is in its lowest position, and the bolt catch 6 is in its upper most position thereby engaging the bolt face in slot 601. A spring 15 presses against a top surface of the bottom arm guide path portion 401 and a bottom surface 602 the bolt catch. This spring serves to bias the bolt catch in an upward position. Embodiments of the release mechanism further comprise a top arm 7.

As shown in FIG. 1, the top arm is pivotally connected to the release mechanism body 1 by a top arm pin 9. The pin 9 extends through a hole 105 formed in the back side 106 of the release mechanism body. The top arm pin 9 may have threads 901 on a forward end adapted to engage a threaded hole 703 in the top arm. The top arm 7 may include a lever lobe 701 and a catch lobe 702. The lever 3 includes an upwardly facing step 306 adapted to engage with the lever lobe 701 of the top arm. The step 306 may be formed generally adjacent to the tab 305 and extend generally horizontally. The bolt catch 6 may include a left leg 603 and a right leg 604 that extends downwardly from the body 605 of the bolt catch. The leg adjacent to the upper arm 7, the right leg in the illustrated embodiments, may include a horizontally extending tab 606. The tab includes a top surface 607.

Turning to FIGS. 13A-B and 19A-B, the top arm lever lobe 701 engages step 306 of the lever 3. As the magazine 17 is inserted into the magazine well 1801, the magazine pushes the lever upward, as described above. As the lever moves upward, the step 306 exerts a force on the lever lobe 701 of the top arm. This causes the top arm to rotate in a clockwise fashion. As the top arm rotates in a clockwise direction, the catch lobe 702 exerts a downward force on the top surface 607 of the bolt catch leg tab 606. This downward force pushes the bolt catch down against the biasing force of spring 15.

Continuing in FIGS. 14A-B and 20A-B, as the magazine reaches its uppermost position, the bolt catch is retracted sufficiently to allow the bolt to move forward, stripping a round 1704*a* from the magazine and positioning it in the chamber 1903. The firearm can then fire in a typical fashion until the final round 1704*c* is stripped from the magazine (see FIGS. 16A-B and 22A-B).

As discussed above, once the final round has been stripped from the magazine, the magazine catch 11 disengages from the magazine and the magazine is allowed to drop from the magazine well. As the magazine drops, the force pressing upward on the lever 3 is released as shown in FIGS. 17A-B and 23A-B. The lever is free to move downwardly, allowing the top arm 7 to rotate in a counterclockwise direction, which allows the bolt catch 6 to extend upwardly in response to the biasing force of the spring 15. When the final round is fired and the bolt is driven back, the bolt catch can now extend upwardly in front of the bolt face and capture the bolt in a rearward position. The process can then be repeated by inserting a loaded magazine containing rounds.

Figure 24:
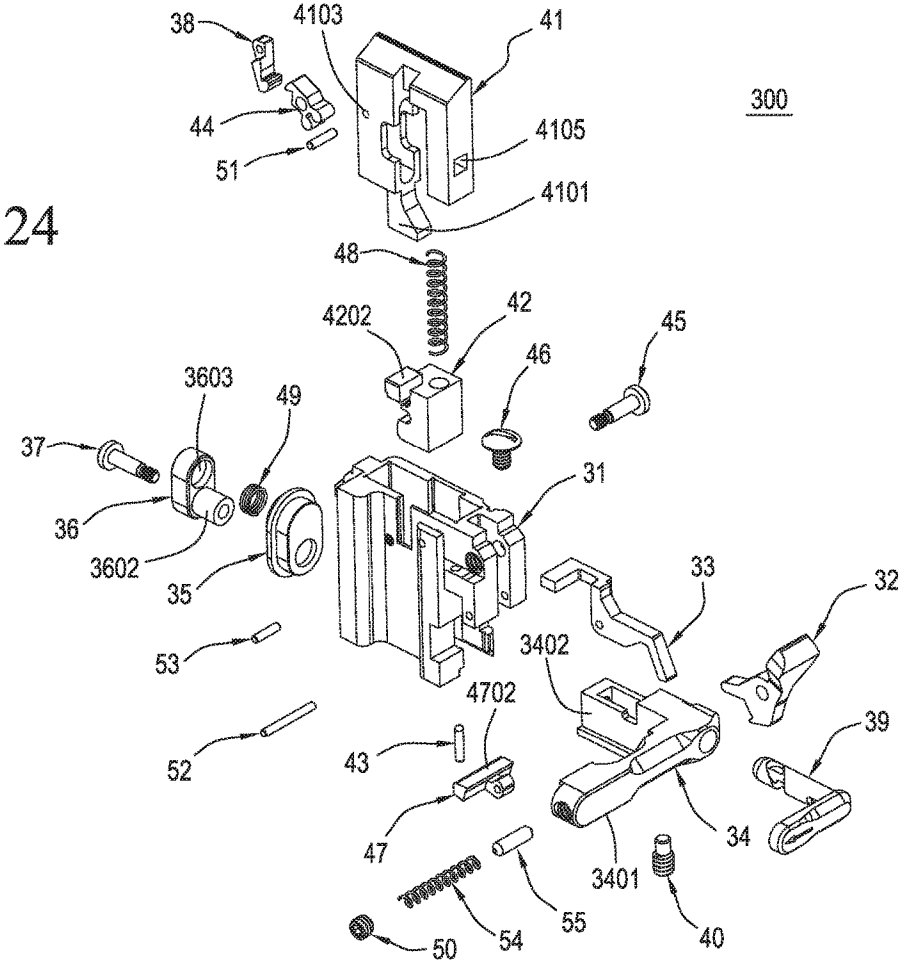
FIG. 24 is an exploded view of a magazine and bolt release mechanism in accordance with an embodiment of the invention.

FIGS. 24-48 illustrate an alternative embodiment of the release mechanism. As shown in FIG. 24, the release mechanism 300 comprises may constitute a preassembled cartridge that is housed in a modified lower receiver. In embodiments of the release mechanism, the lower receiver may be modified from a standard firearm receiver, in particular, the lower receiver may be a modified AR-15 receiver. In certain embodiments, modifications to a lower receiver may be internal such that no external changes are required to adapt an AR-15 pattern rifle to the release mechanism. In addition, embodiments may not require modifications to the upper receiver, bolt or fire control group or the firearm.

Embodiments of the release mechanism 300 contemplate a selectable magazine catch comprising a selector that toggles an automatic magazine drop feature on and off. The magazine catch can be operated in a fashion typical of existing firearms, for example via a magazine release button that exists in the typical location and is actuated by typical means. Alternatively, the magazine catch can be operated in a manner to automatically drop the magazine.

The release mechanism 300 may be positioned in a lower receiver 18 in a similar position to that disclosed with regard to other embodiments. See, for example, release mechanism 100 in FIG. 3. FIGS. 24-33 illustrate an embodiment of the release mechanism. It should be noted that FIGS. 25C, 26C, etc. show a cross-sectional view of Section A-A, which looks backward toward the rear of the firearm. Accordingly, the right and left side of these sectional views is reversed with regard to the firearm. The release mechanism may be secured to the lower receiver 18 by a screw 46.

The release mechanism comprises a magazine catch mechanism. The magazine catch mechanism may include several components, including a magazine catch 34, a magazine release button sleeve 35, and a magazine release button 36. The magazine catch 34 may comprise a catch arm 3401 that extends forward generally parallel to a side of the lower receiver 18. The magazine catch further comprises a catch body 3402 that extends perpendicular to the arm into the release mechanism body 33. The catch arm may be positioned along a left side of the firearm. The catch body 3402 comprises an end wall 3403 positioned generally adjacent to the right side of the release mechanism. The end wall 3403 may include a threaded hole 3404. A screw 37 may extend through a hole 3601 in the magazine release button 36 to attach the release button 36 to the end wall 3403. The magazine button 36 may comprise a cylindrical extension 3602 through which the hole 3601 extends. The cylindrical extension 3602 may engage a hole 3501 formed in the release button sleeve 35.

The release button 36 may also include a socket or cavity 3603 on an inner surface that engages the end of a spring 49. The release button sleeve may have a corresponding cavity 3502 on its outer side that engages an opposite end of the spring 49. The button sleeve may also include a sidewall 3503 surrounding at least a portion of the release button 36. In this manner, the spring 49 biases the button 36 in an outward direction away from the sleeve 35. The button 36 is connected to the catch arm 34 by the screw 37. Therefore, the spring biases the catch arm in an inward direction tending to move the catch arm into a position in which an engagement tooth 3405 engages a slot 1703 in the magazine 17.

The magazine catch mechanism may further comprise a switch 39. The switch may comprise a switch lever 3901.

The switch lever may extend generally in line with a portion of the catch arm 3401. The switch 39 may also include a post 3902 that terminates in a follower 3903 formed on the end of the post. A setscrew 40 may attach the switch 39 to the catch 34.

Figure 25A:
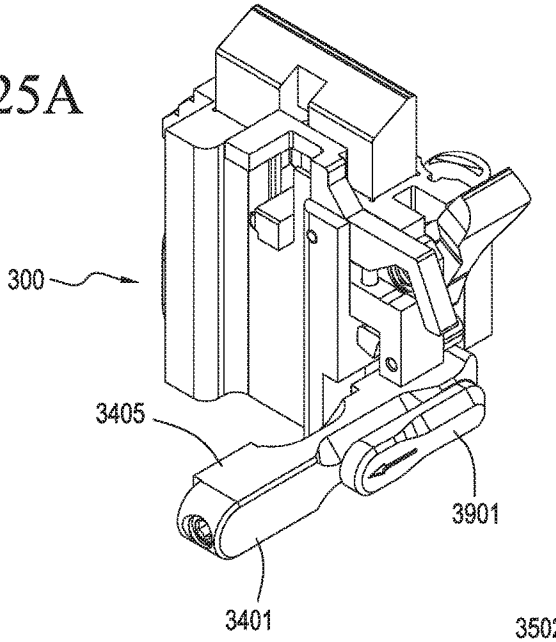
FIGS. 25A-33C are perspective, side and cutaway views of an embodiment of the present invention showing various steps of a loading and firing cycle.
Figure 25B:
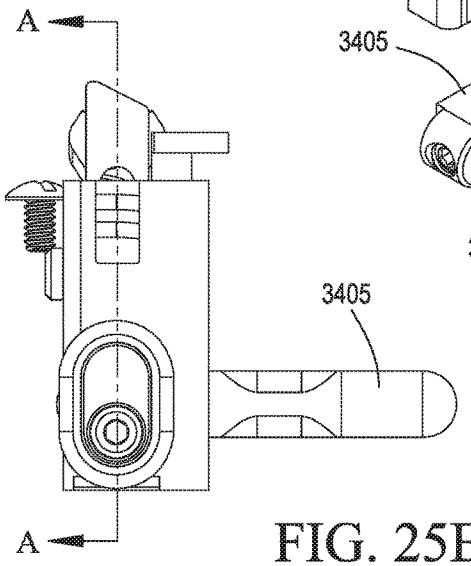
Figure 25C:
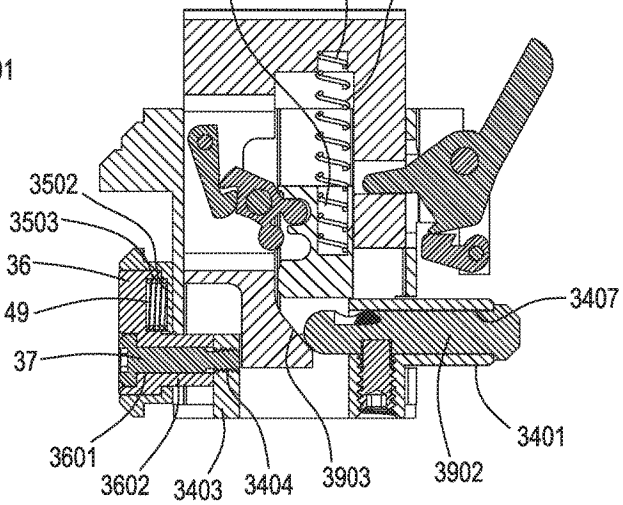

FIGS. 25A-C show the illustrative embodiment in an initial position before a magazine 17 has been inserted into the magazine well 1801 of the lower receiver 18. In this position, the magazine catch is held in a leftward position against the bias of spring 49 by operation of a force applied to follower 3903 by a cam 4101 formed at a lower end of the bolt catch 41. As the magazine 17 is inserted into the magazine well 1801 (see FIGS. 26A-C), the top edge 1705 of the magazine 17 applies a force to a bottom surface 4201 of a tab 4202 extending forwardly from a top edge of a bolt drop arm 42. The bolt drop arm 42 moves upwardly as shown by arrow 1903. A spring 48 presses against a downward facing surface of the bolt catch 41 and an upward facing surface of the bolt drop arm 42, biasing the bolt in an upward position. The bolt catch may include a recess 4107 to secure an upper end of the spring, and the bolt drop arm may include a recess 4203 to secure a lower end of the spring.

As the bolt drop arm 42 moves upwardly, teeth 4203 formed in a sidewall of the bolt drop arm engage corresponding teeth 4401 formed on an arm of a bolt drop gear 44. The bolt drop gear 44 is positioned inside the release mechanism main body 31 and connected to the main body for rotational movement by a bearing pin 51 that extends through an axial hole 4403 in the gear. The pin extends through the axial hole and engages holes 3101 in the front 3102 and rear 3103 walls of the main body. A cutout 4102 in the bolt catch 41 provides clearance for the bolt catch to move up and down relative to the bolt drop gear 41 and its bearing pin 51.

Figure 26A:
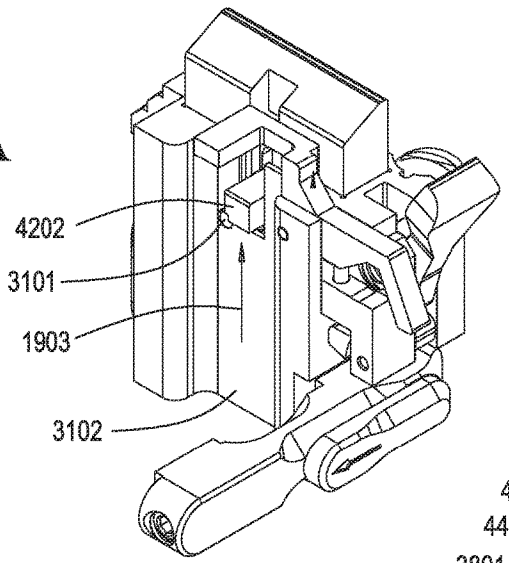
Figure 26B:
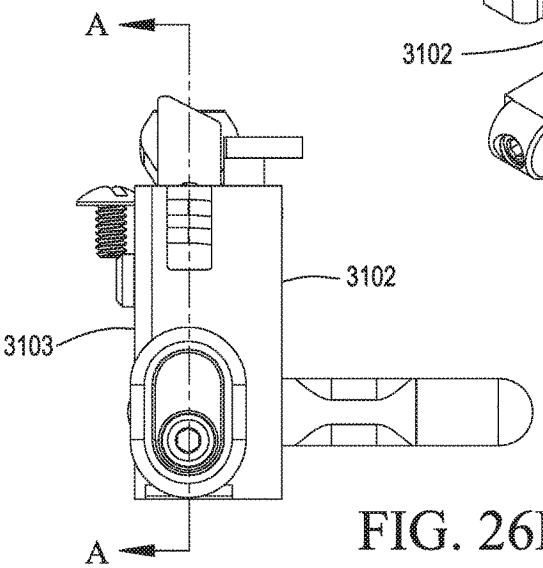
Figure 26C:
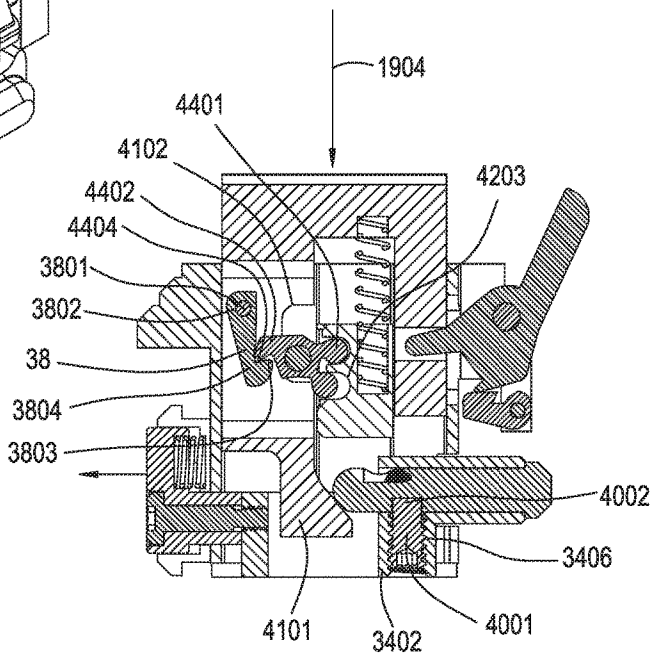

The upward movement of the bolt drop arm causes the bolt drop gear to move in a counterclockwise direction (as viewed in FIG. 26C, for example). As the teeth 4401 on the left side of the gear 44 move upwardly, a lever arm 4402 on the opposite side of the gear moves downwardly. The bolt drop gear lever arm 4402 engages a bolt drop catch 38. The bolt drop catch is positioned within the body of the bolt catch 41. The catch 38 has a hole 3801 formed at its upper end 3802. The hole 3801 engages a pin that also engages holes 4103 that pass through front and rear walls of the bolt catch 41. The bolt drop catch 38 also includes an engagement tooth 3803 and its lower end 3804. The tooth 3803 engages a corresponding catch tooth 4404 formed on the lever arm 4402 of the bolt drop gear. Accordingly, the rotation of the bolt drop gear 44, in response to the upward movement of the bolt drop arm 42, causes the bolt drop gear lever 4402 to rotate downwardly. Because the bolt drop gear lever catch tooth 4404 is engaged with the bolt drop catch tooth 3803, the bolt drop catch, and the bolt catch 41 that is attached to it, move downwardly as shown by arrow 1904. This downward movement of the bolt catch moves the bolt catch cam 4101 downwardly, which allows the spring 49 to move the magazine catch inwardly so the magazine catch tooth 3405 can engage with the magazine slot 1703.

Figure 27A:
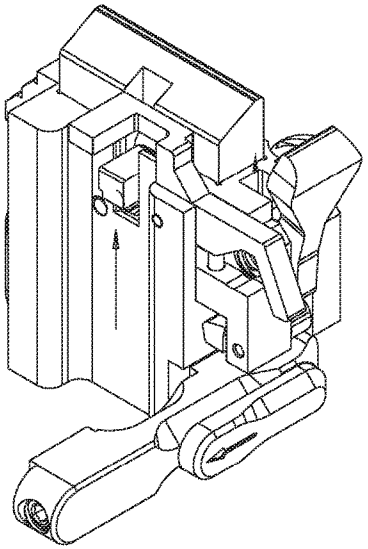
Figure 27B:
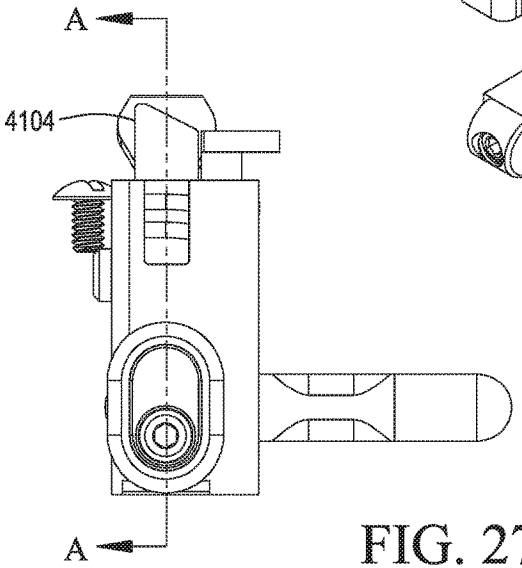
Figure 27C:
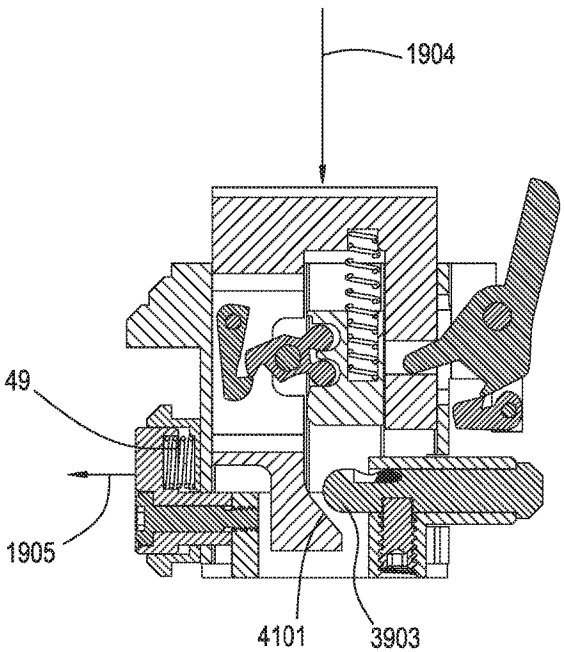

As shown in FIGS. 27-28, the cam 4101 continues to move downwardly, allowing the spring 49 to bias the magazine catch 34 to its rightmost position (as indicated by arrow 1905), completely engaging the magazine. The magazine retention apparatus, including the magazine catch 34, will remain in this position until the last round 1704*c* is fired.

As with bolt catch 6, described above, the bolt catch 41 holds the bolt in a rearward position by engagement of a lower edge 2001 of the bolt face 2002 with a rear face 4104 adjacent an upper edge of the bolt catch. Turning now to the movement of the bolt catch 41 with reference to FIGS. 25-33. As described above, as the magazine is inserted, the magazine top edge 1705 pushes upwardly on the bolt drop arm tab 4202 bottom surface 4201. The bolt drop 42 moves upwardly causing the bolt drop gear 44 to rotate and the bolt catch 41 to move downwardly.

Figure 28A:
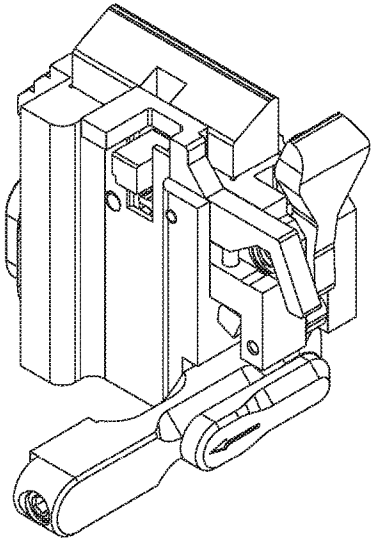
Figure 28B:
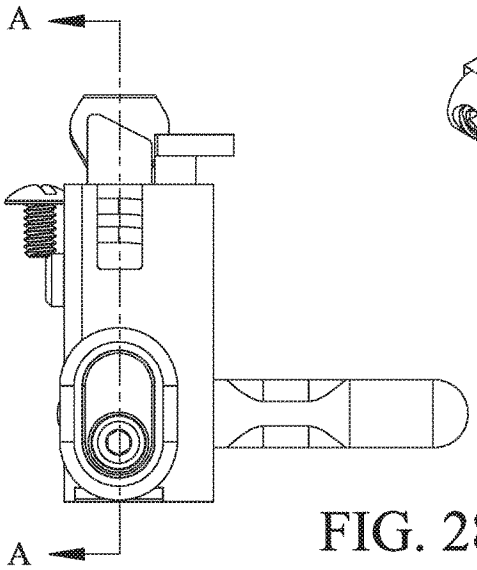
Figure 28C:
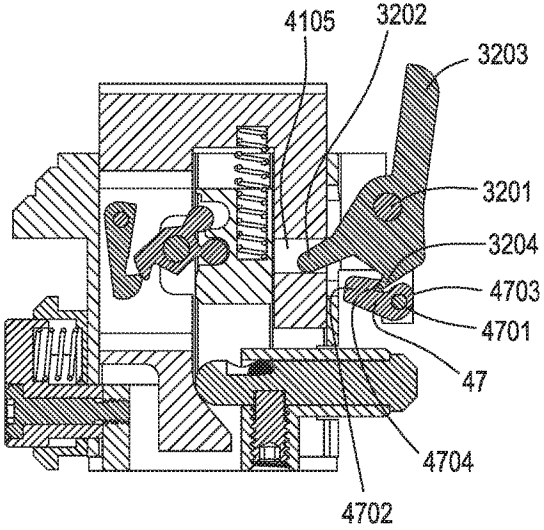

Referring to FIGS. 28-29, the bolt catch mechanism further includes bolt catch release 32. The bolt catch release is secured to a left side of the main body 31 by a top arm pin 45. The top arm pin may pass through a hole 3201 in the bolt catch and engage a hole in the main body. The hole and pin may have corresponding threads. The bolt catch release may comprise an inner lever 3202, an outer lever 3203 and a catch tooth 3204. The inner lever 3202 is positioned within a slot or aperture 4105 formed in a left sidewall 4106 of the bolt catch 41. As the bolt catch moves downwardly, the bolt catch release rotates in a counter clockwise direction (as viewed in FIG. 28C, for example) such that the outer lever 3203 moves inwardly. As the bolt catch 41 reaches is lowest point, the bolt catch release 32 engages with a release retainer 47. The release retainer is pivotally connected with the main body 31 by a bearing pin 52. The release retainer has a first end 4703 with a hole 4701 that engages the bearing pin 52. At its other end, the release retainer comprises an engagement block 4702 that extends longitudinally. The engagement block extends rearward wider than the first end 4703, in order to engage the bolt catch release 32. The opposite or front side is wider than the first end in order to engage with a release arm 33, described in more detail below.

As the bolt catch 41 moves downwardly and the bolt catch release inner lever rotates downwardly, an engagement tooth 4704 on the engagement block 4702 of the release retainer engages the catch tooth 3204 of the bolt catch release 32. This engagement locks the bolt catch release against rotation. In this position an end of the inner lever 3202 pushes against a lower surface of the bolt catch aperture 4105, and the bolt catch is thereby locked in a lowered position.

Figure 29A:
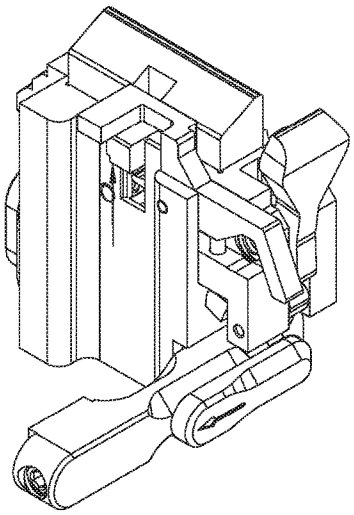
Figure 29B:
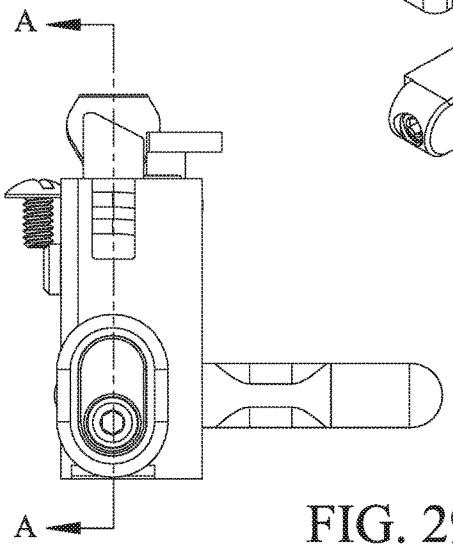
Figure 29C:
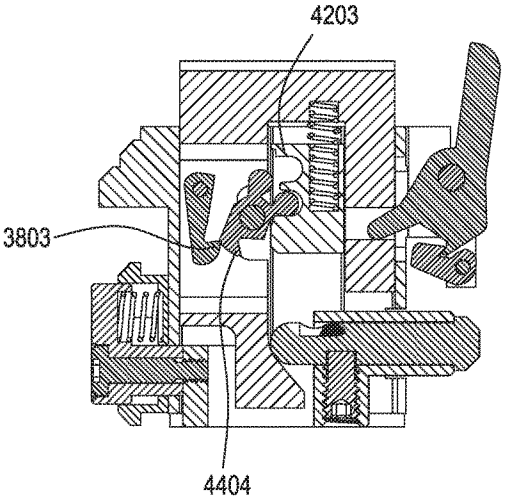
Figure 30A:
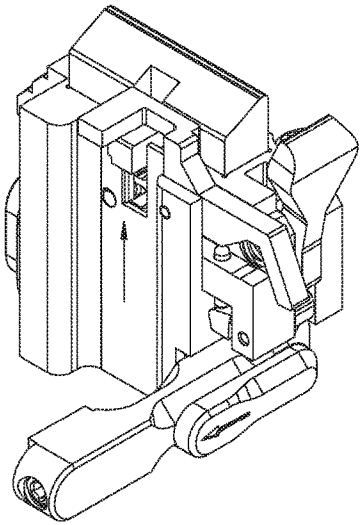
Figure 30B:
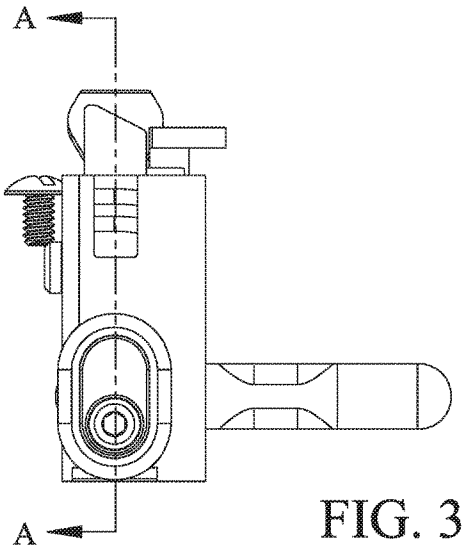
Figure 30C:
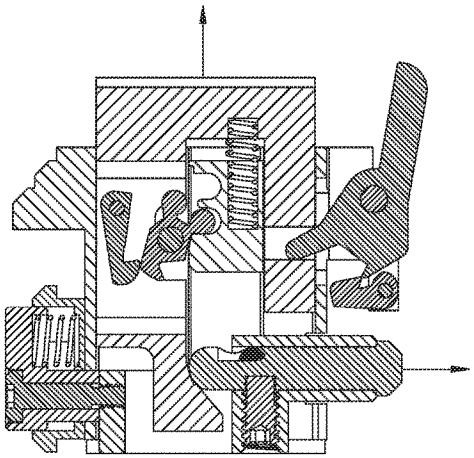
Figure 31A:
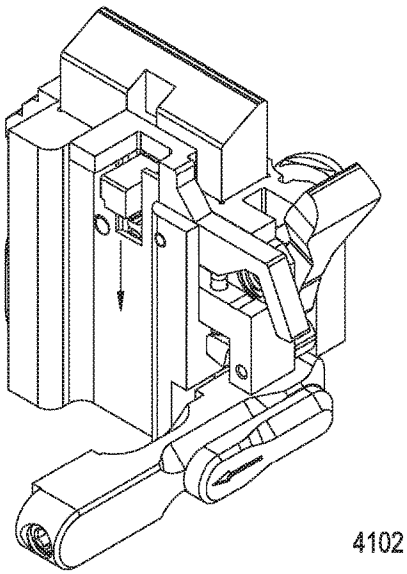
Figure 31B:
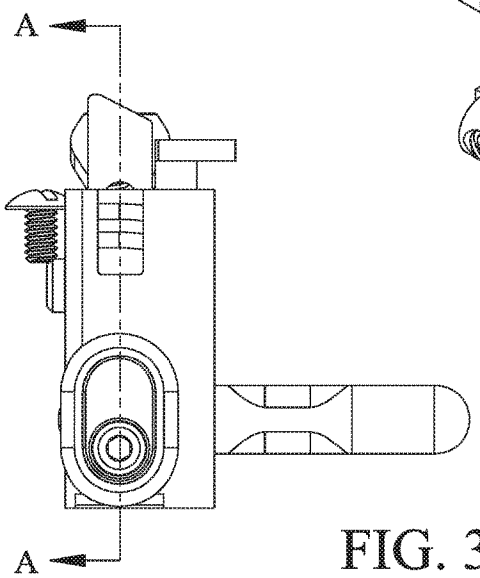
Figure 31C:
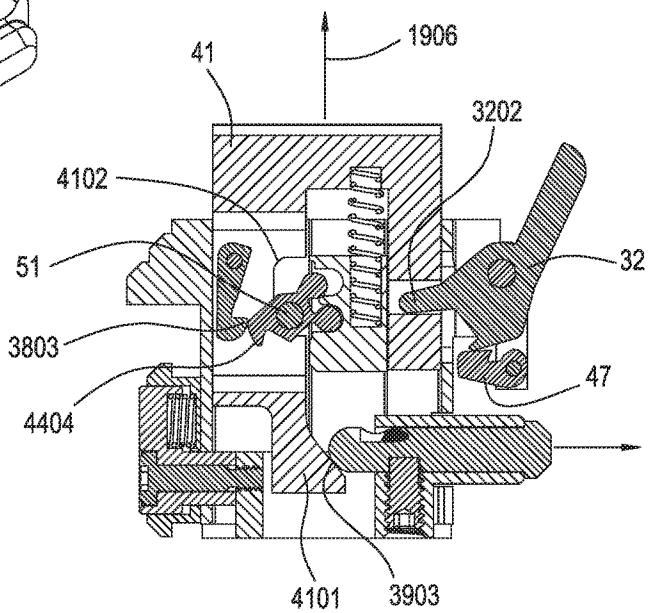

At this point, as shown in FIGS. 28A-C, the bolt drop arm 42 continues to move upwardly, rotating the bolt drop gear catch tooth 4404 beyond its engagement with the bolt drop catch tooth 3803. The bolt drop catch 38 is now disengaged from the bolt drop gear, and the bolt catch 41 is held in a lowered position by the bolt catch release and the release retainer 47. The firearm may be fired until the last round has been stripped from the magazine 17. Once the final round has been stripped from the magazine and is positioned in the chamber, as shown in FIGS. 29A-C, a step 1708 in a rear edge of the follower 1707 engages with the tab 4202 of the bolt drop arm 42, driving the bolt drop arm a distance above the top edge 1706 of the magazine rear wall 1706 (see FIG. 22B).

In embodiments of the release mechanism, the bolt catch release 32 and release retainer remain engaged while the bolt is in the forward position prior to firing the final round. While the bolt is in a forward position, a surface of the bolt mechanism (not shown) engages with a corresponding surface on the follower and holds the follower a distance from its topmost position. This distance may be small compared to the total travel of the follower. For example, the distance may be less than 0.010 inches. The distance may be less than 0.005 inches and may be about 0.001 inches. Once the final round has been fired, the bolt moves backward in accordance with the cycle of the firearm. When the bolt mechanism clears the magazine follower on its backward stroke, the magazine follower is allowed to move upwardly a final distance. This final movement allows the release retainer 47 to disengage from the bolt catch release 32.

Once the release retainer 47 disengages from the bolt catch release 32, the bolt catch release inner lever 3202 is allowed to rotate upwardly. This allows the bolt catch 41 to move upwardly as shown by arrow 1906 in FIG. 31C. Because the bolt drop gear catch tooth 4404 has disengaged from the bolt drop catch tooth 3803, the bolt drop arm 42 moves relative to the bolt catch 41 with the bolt gear bearing pin 51 moving downwardly within bolt catch cutout 4102 as the bolt catch moves upwardly. The bolt catch is allowed to move to its upper position where it engages with the bolt to lock the bolt in a rearward position.

Figure 32A:
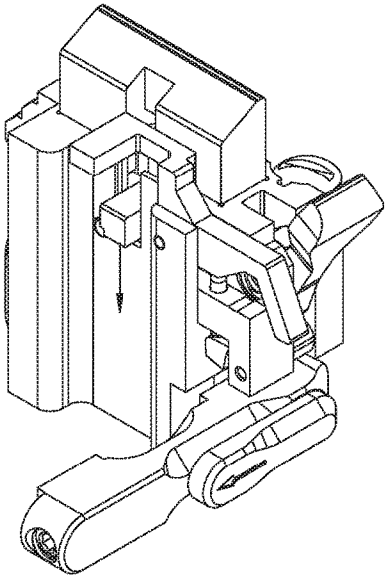
Figure 32B:
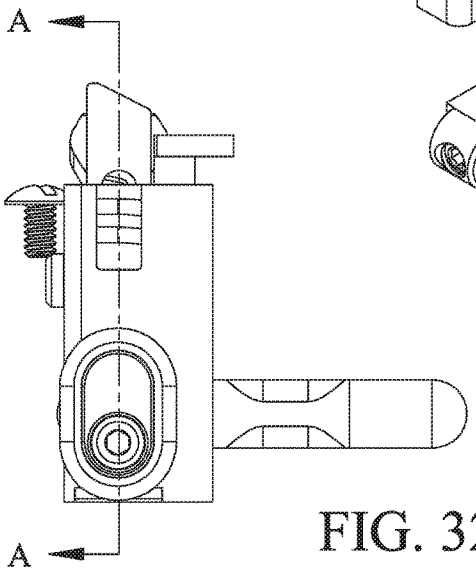
Figure 32C:
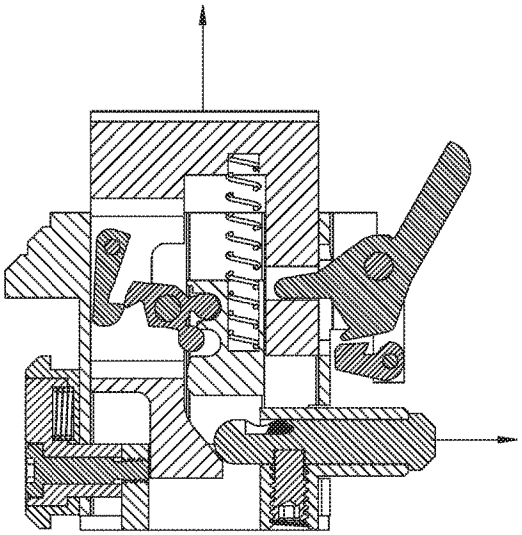
Figure 33A:
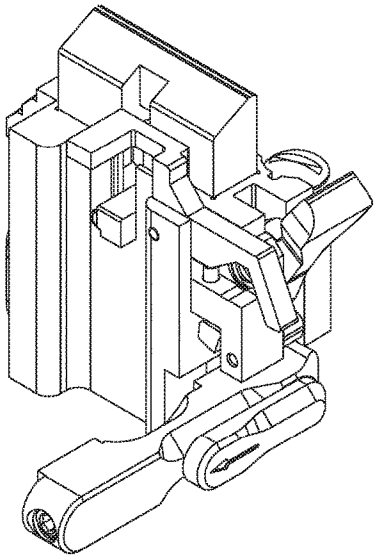
Figure 33B:
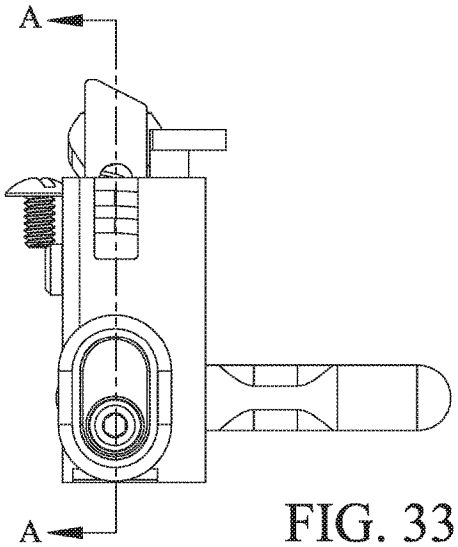
Figure 33C:
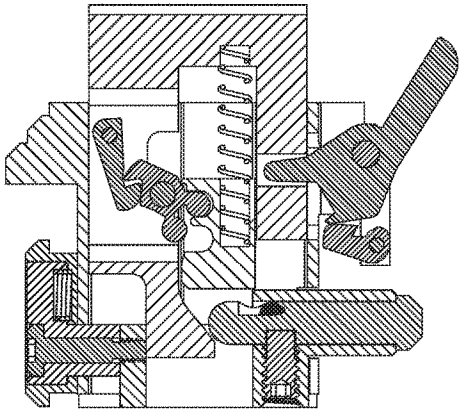

Simultaneously, the bolt catch cam 4101 moves upwardly together with the rest of the bolt catch 41, forcing the magazine catch follower 3903 to move outwardly. This disengages the magazine catch tooth 3405 from the magazine slot 1703, allowing the magazine to drop from the magazine well 1801. As the empty magazine is released and drops from the lower receiver, the components return to their initial positions as shown in FIGS. 32-33. The process can then be repeated by inserting a loaded magazine.

As shown in FIGS. 34-38, the magazine release mechanism may be selectively disengaged from operation of the release mechanism. The magazine release mechanism may include a magazine catch 34 and a switch 39. The magazine catch may include an external catch arm 3401 and an internal catch body 3402. The switch may comprise a switch lever 3901. The switch lever may extend generally in line with a portion of the catch arm 3401. The switch 39 may also include a post 3902 that terminates in a follower 3903. Operation of the follower in conjunction with the bolt catch 41 is described above.

The switch post 3902 extends through a hole of the catch arm 3401 into a cavity or aperture in the catch body 3402. The cam 4101 of the bolt catch also extends into this aperture. As shown in FIG. 26C, for example, the switch post is secured to the catch body by a setscrew 40. The setscrew may include a threaded portion 4001 that engages a corresponding threaded hole 3406 in the catch body 3402. The setscrew may also include a non-threaded portion 4002 that extends beyond an inner diameter of the hole 3407 in the catch arm through which the switch post 3902 extends.

Figure 34B:
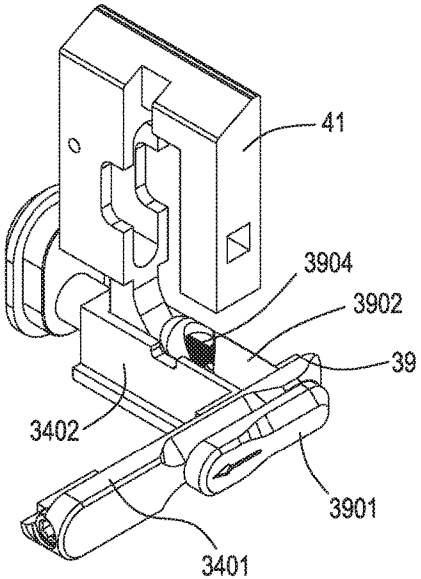
FIGS. 34A-38D are various partially cutaway perspective, front and side views of embodiments of a mechanism for disengaging a magazine release mechanism.
Figure 34A:
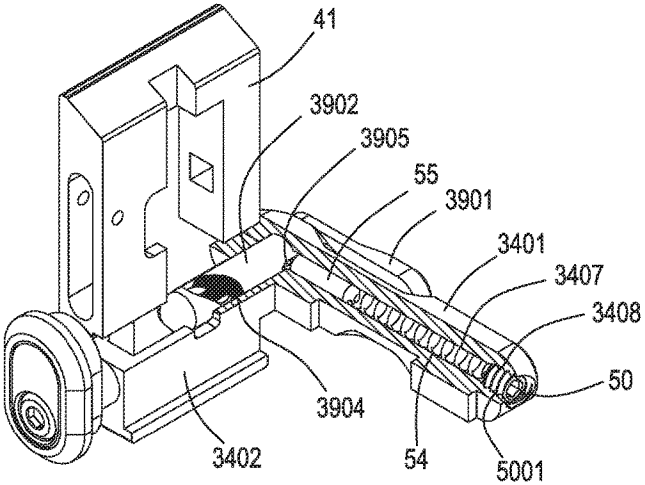
Figure 34C:
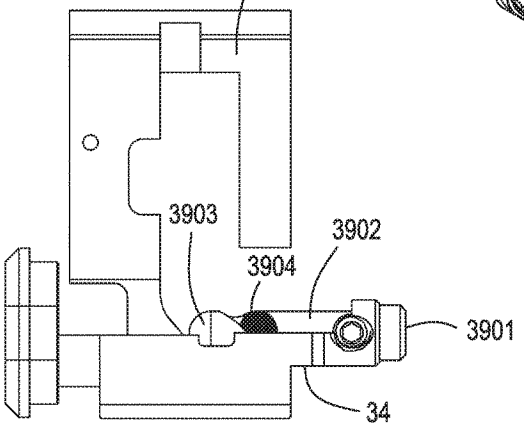
Figure 35B:
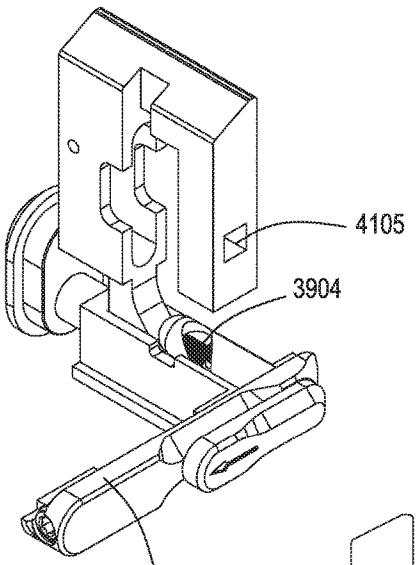
Figure 35D:
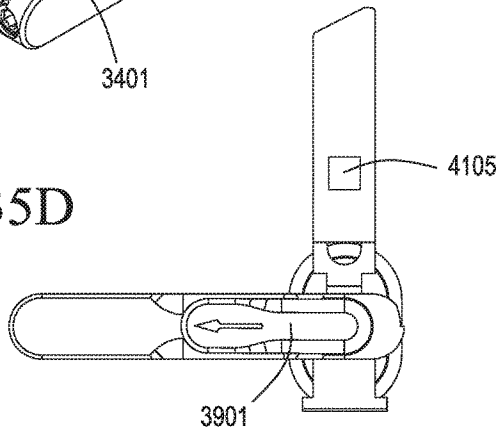
Figure 35A:
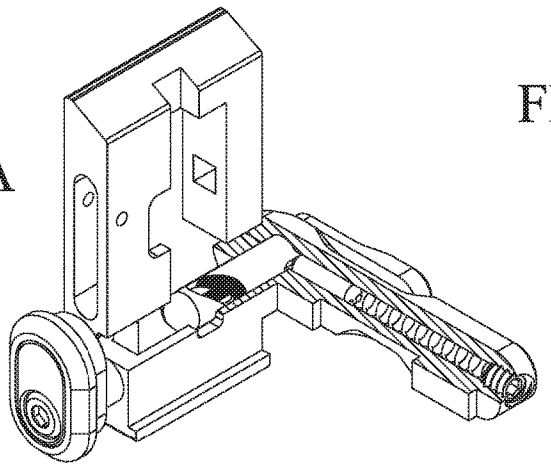
Figure 35C:
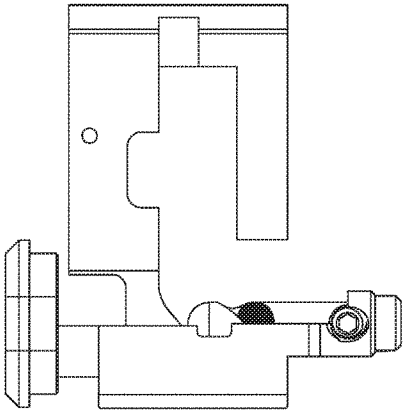
Figure 36B:
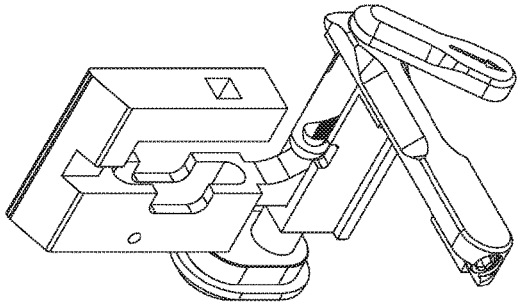
Figure 36D:
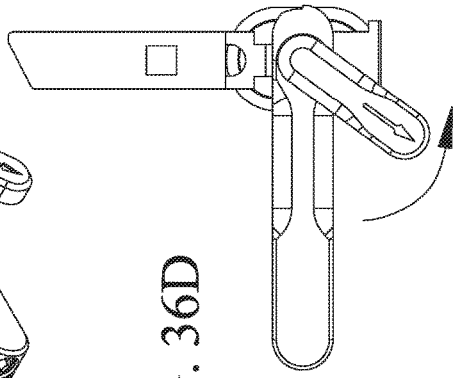
Figure 36A:
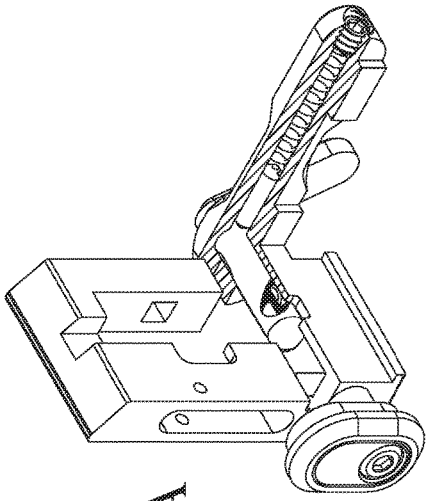
Figure 36C:
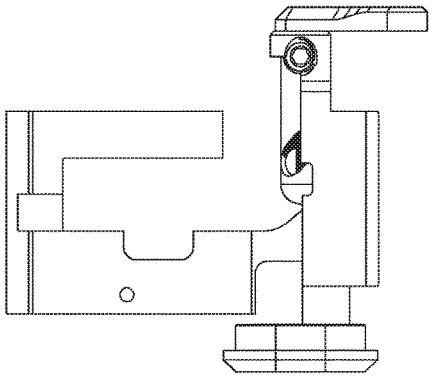
Figure 37B:
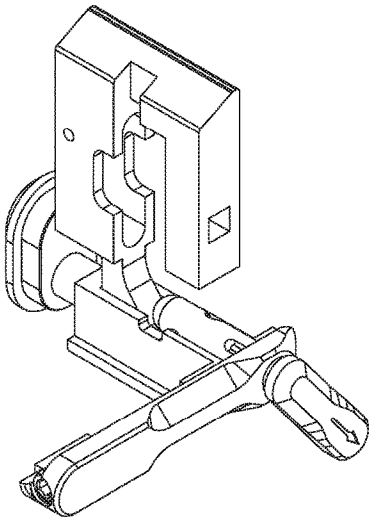
Figure 37D:
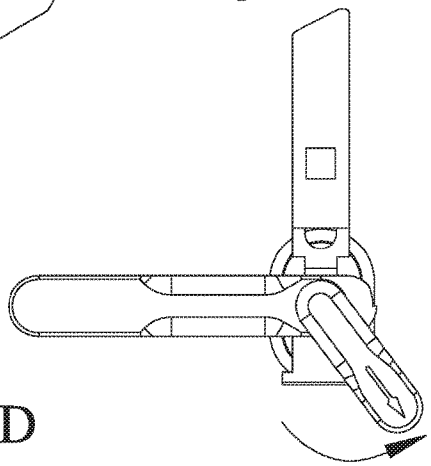
Figure 37A:
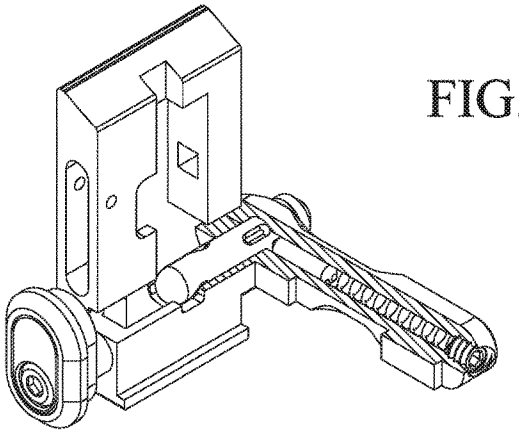
Figure 37C:
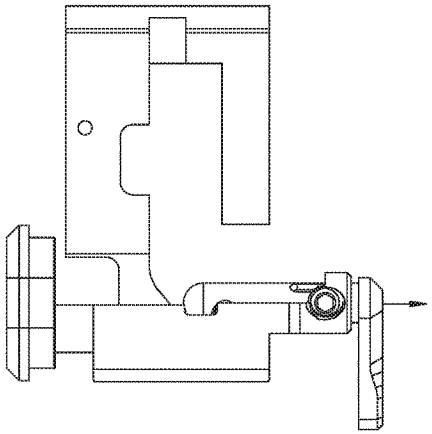
Figure 38B:
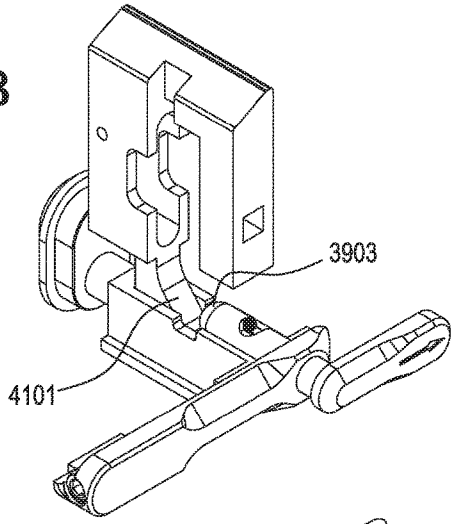
Figure 38D:
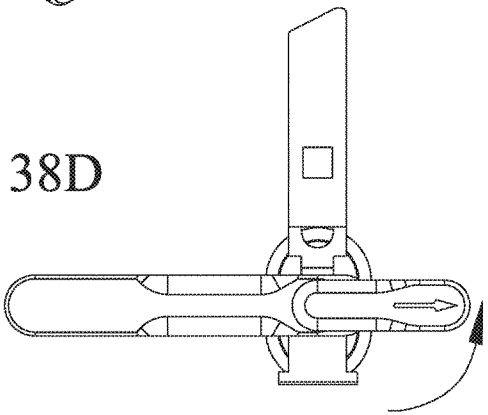
Figure 38A:
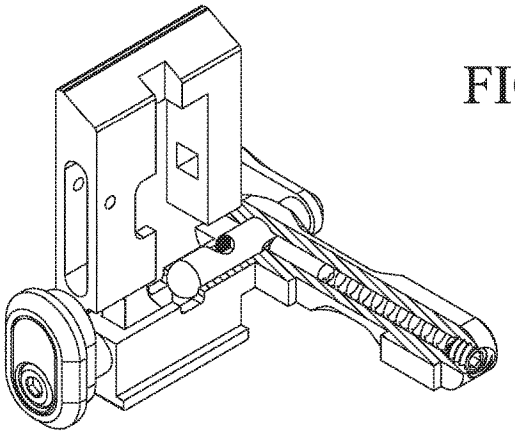
Figure 38C:
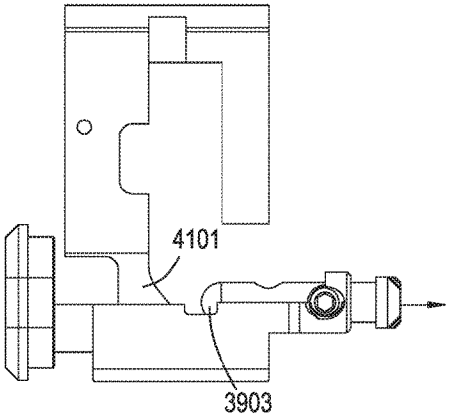

Returning to FIGS. 34-38, the setscrew non-threaded portion may extend into a helical pathway 3904 formed in an outer surface of the switch post 3902. As shown in FIGS. 34-35, when the switch lever 3901 is aligned with the catch arm 3401, the switch lever is positioned generally adjacent to an outer surface of the catch arm, and the setscrew is positioned at an outer limit of the helical pathway. From this position, the switch lever 3901 may be rotated relative to the catch arm 3401 as shown in FIGS. 36-37. As the switch lever is rotated, the setscrew follows the helical pathway and the switch lever 3901 is pushed outwardly relative to the magazine catch arm 3401. The setscrew reaches an inner limit of the helical pathway and the switch lever has been pushed outwardly to its greatest extent when the switch lever has been rotated 180 degrees as shown in FIGS. 38A-C. This rotation and translation of the switch lever 3901 pulls the switch follower 3903 from its position of contact with the cam 4101 of the bolt catch 41.

The magazine release mechanism may further include a detent 55. The detent may be positioned in a bore 3407 within the catch arm 3401. The detent 55 may engage one or more depressions 3905 in an outer surface of the post 3902 in order to retain the switch lever 3901 at certain angles of rotation, for example at 0 degrees and 180 degrees. A spring 54 may also be placed in the bore 3407 to apply a biasing force to the detent 55. In addition, a setscrew 50 may be positioned in the bore to contain the spring and, in some embodiments, to adjust the amount of tension supplied by the spring. The setscrew may have threads 5001 that correspond to threads 3408 formed on an inner surface of the bore 3407.

Figure 39B:
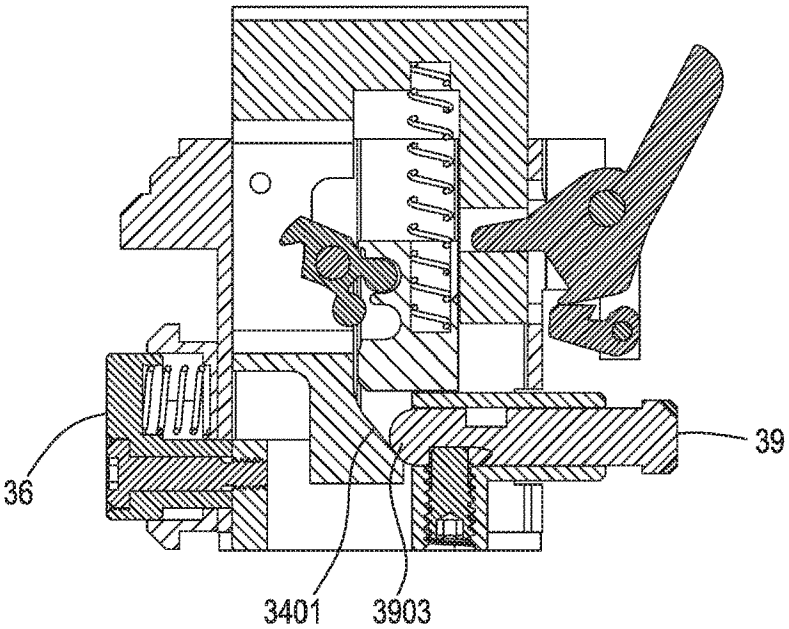
FIGS. 39A-41B are side and cross-section views of the embodiment of FIGS. 34A-38D showing various steps of a loading and firing cycle.
Figure 39A:
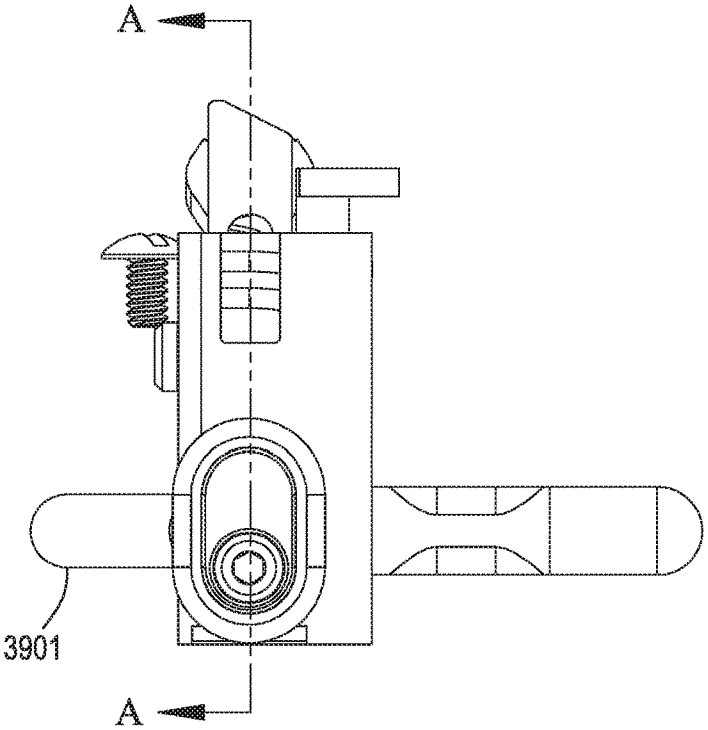
Figure 40B:
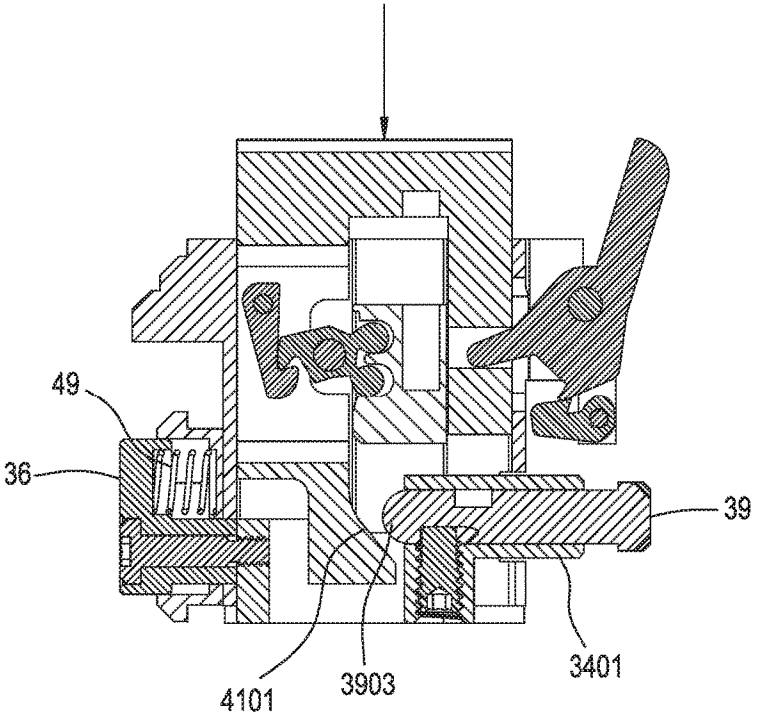
Figure 40A:
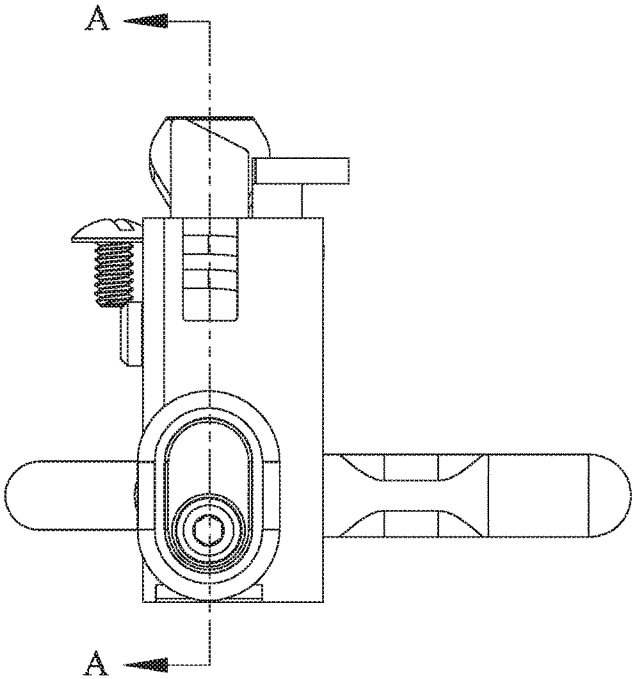
Figure 41B:
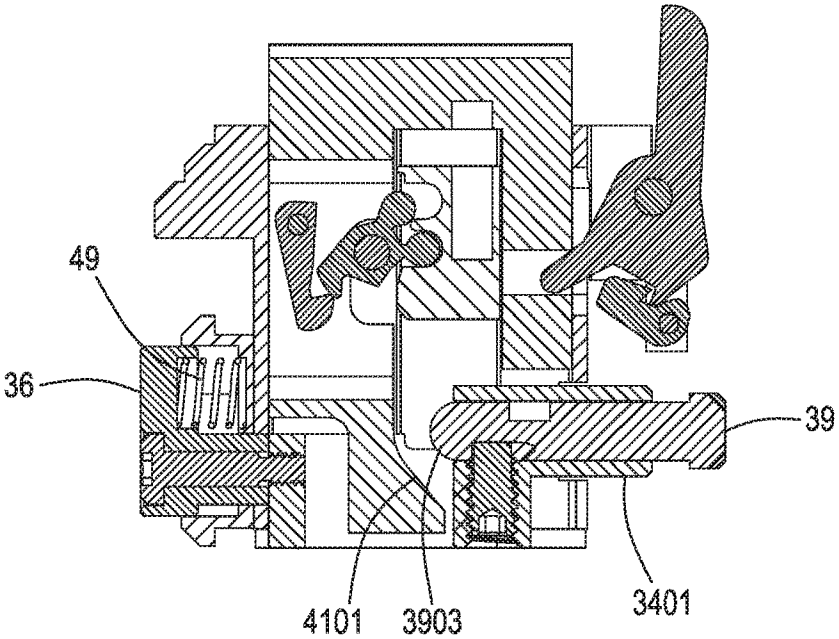
Figure 41A:
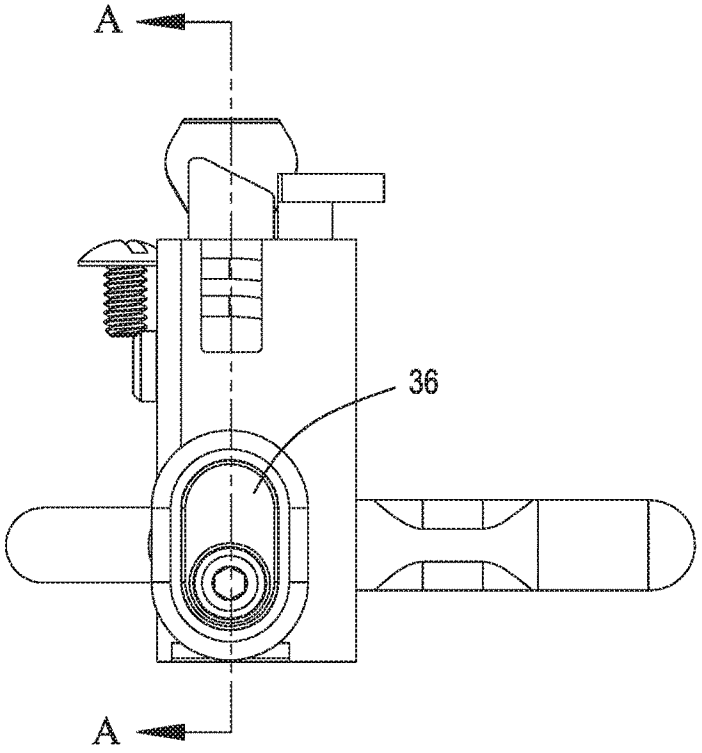
Figure 42A:
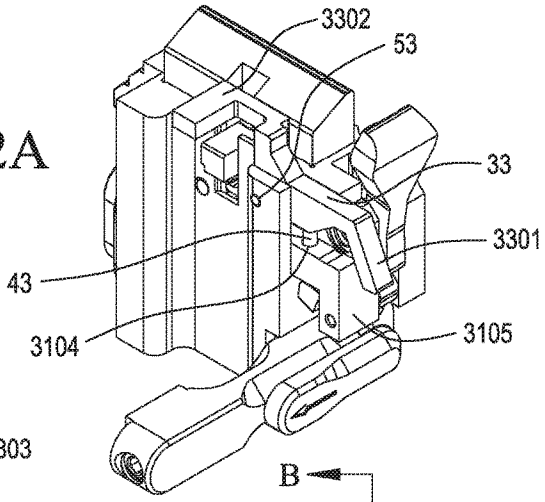
FIGS. 42A-48D are perspective, front, side and cross-sectional views of embodiments of a mechanism for disengaging a bolt and magazine release mechanism.
Figure 42C:
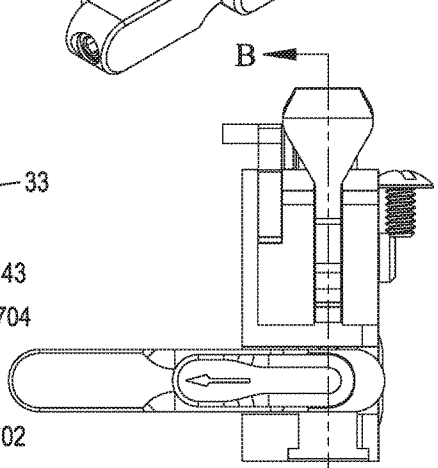
Figure 42B:
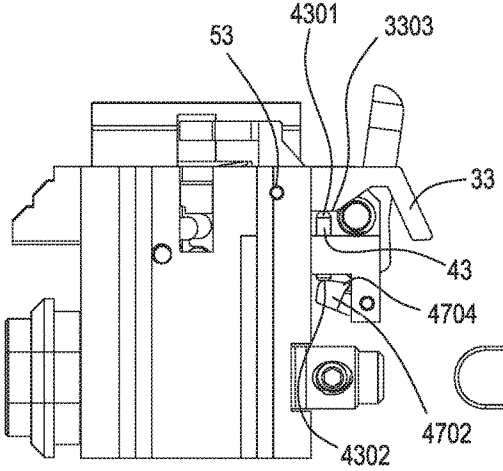
Figure 42D:
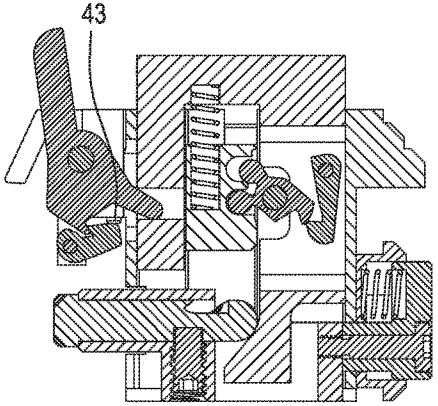
Figure 43A:
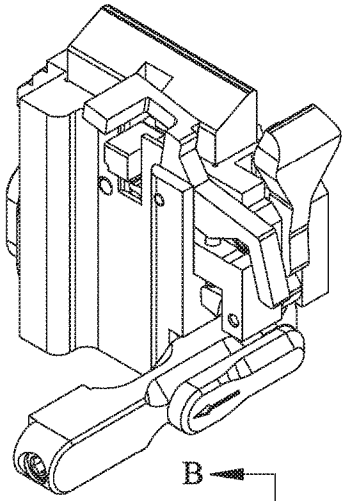
Figure 43C:
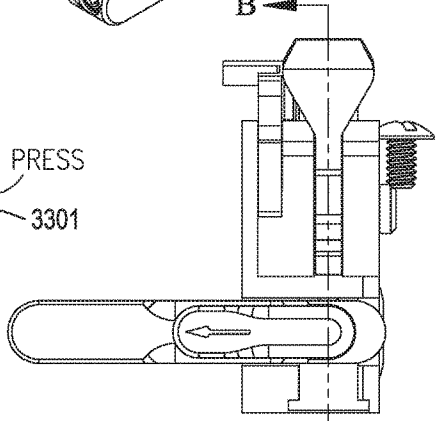
Figure 43B:
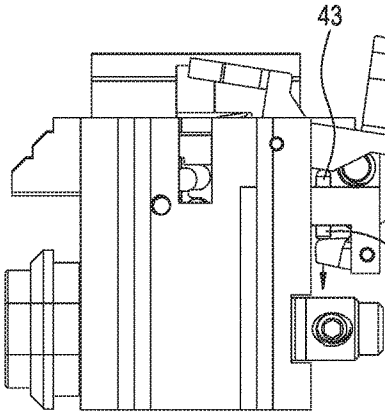
Figure 43D:
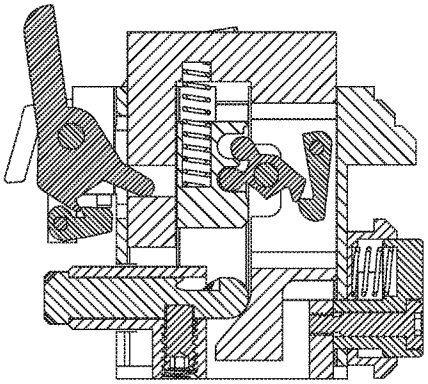
Figure 44A:
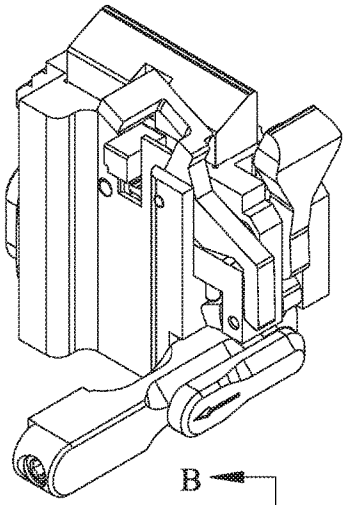
Figure 44B:
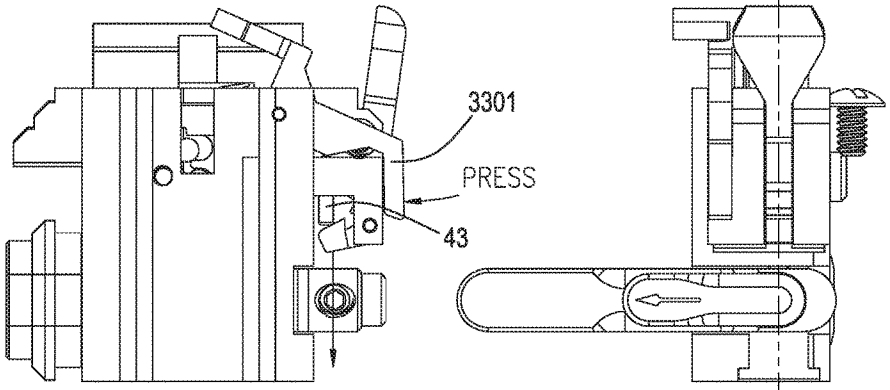
Figure 44C:
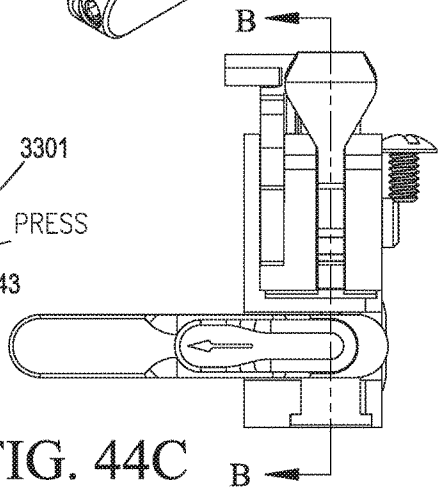
Figure 44D:
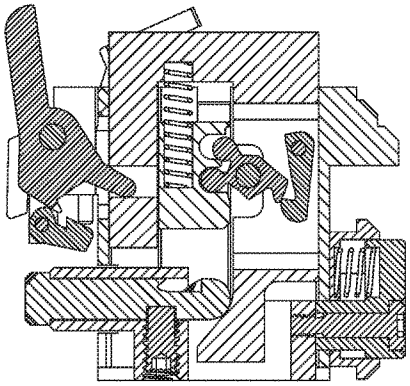
Figure 45A:
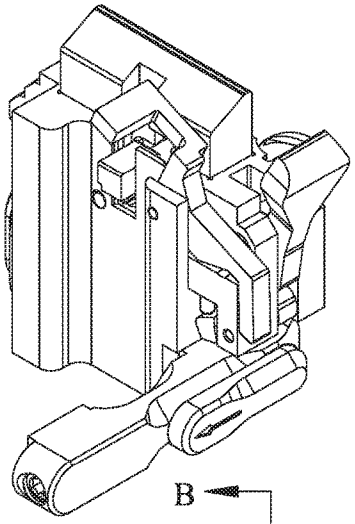
Figure 45C:
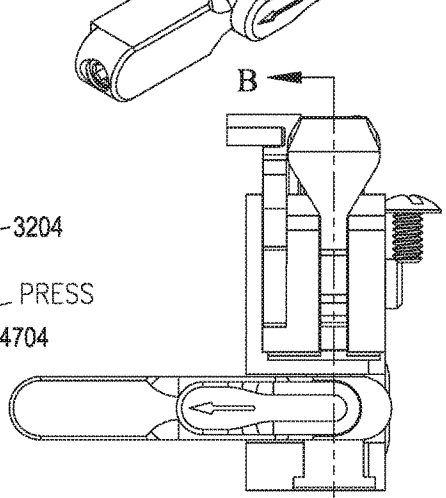
Figure 45B:
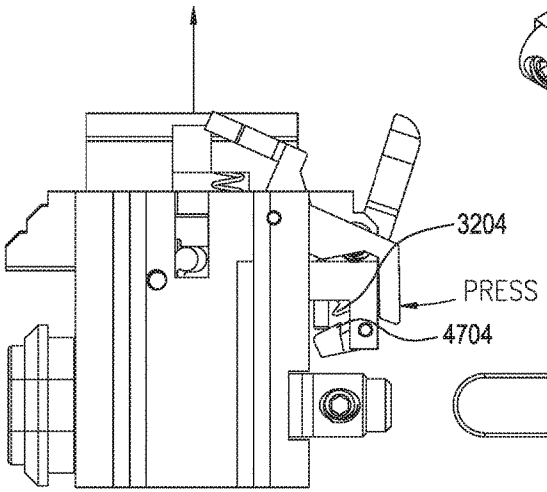
Figure 45D:
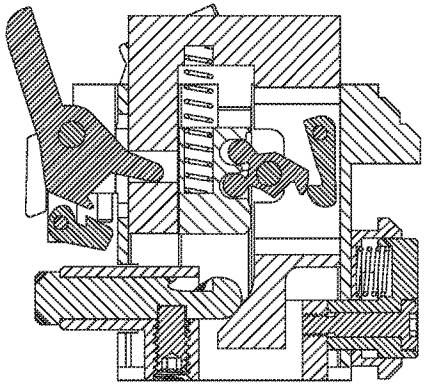
Figure 46A:
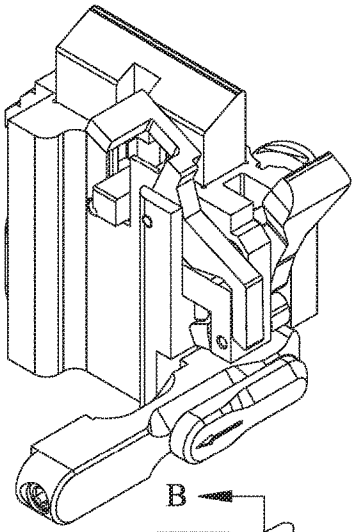
Figure 46C:
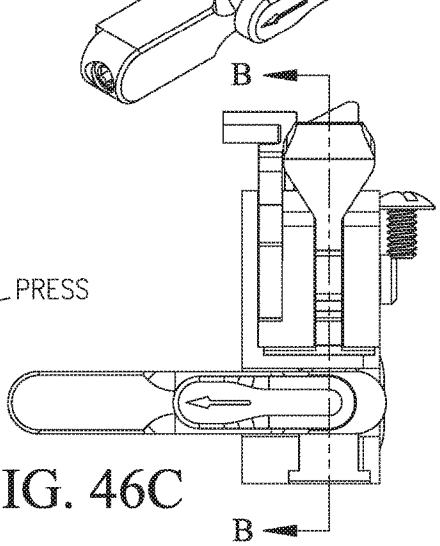
Figure 46B:
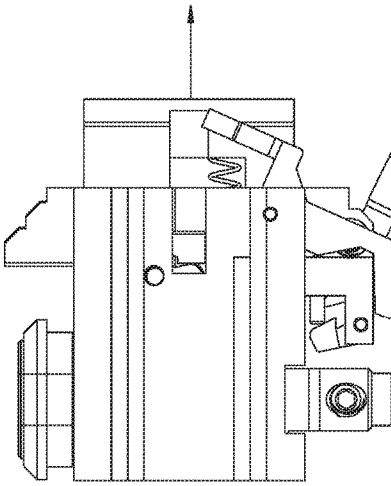
Figure 46D:
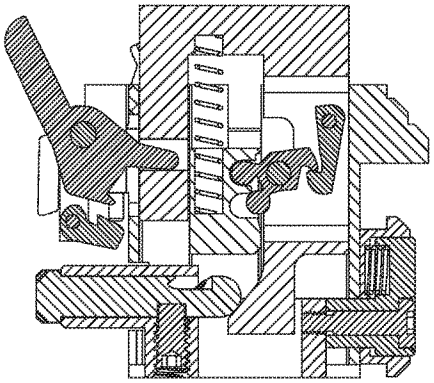
Figure 47A:
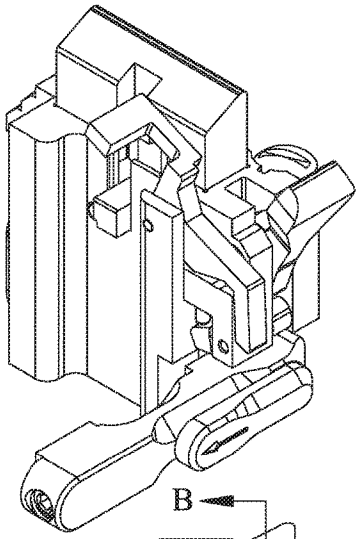
Figure 47C:
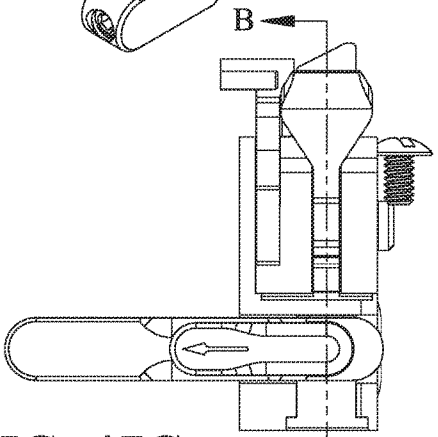
Figure 47B:
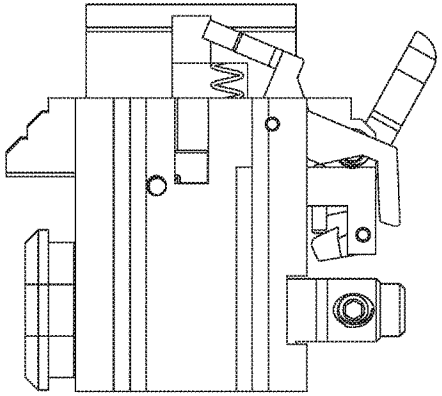
Figure 47D:
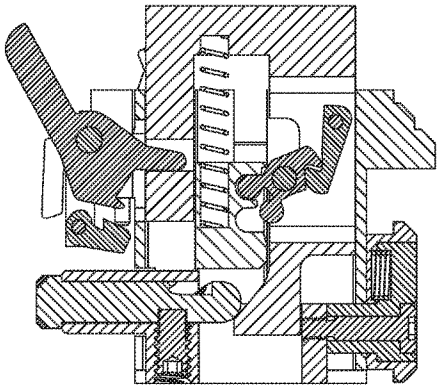
Figure 48A:
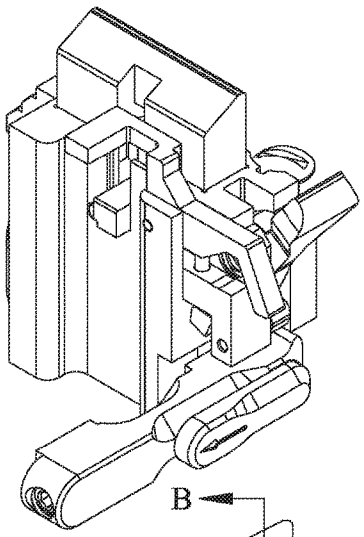
Figure 48C:
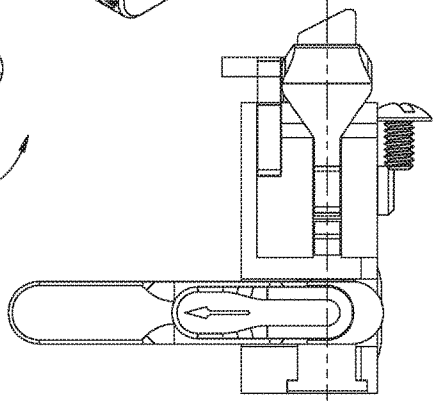
Figure 48B:
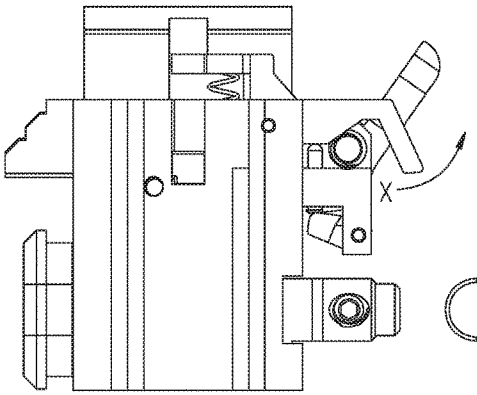
Figure 48D:
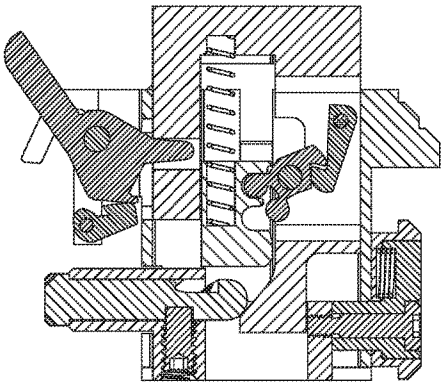

FIGS. 39-41 show the operation of the magazine catch mechanism with the switch rotated into a non-engaged position. As can be seen from these figures, the switch follower 3903 is no longer driven by the bolt catch cam 4101. Instead, the spring 49 biases the catch arm 3401 to its inward position where the catch arm tooth engages the magazine slot. In this manner the magazine release is deactivated, and the magazine is retained regardless of the action of the release mechanism until the shooter presses the magazine release button 36 or reactivates the switch mechanism 39.

As described above, in embodiments of the release mechanism, the release retainer 47 captures the bolt catch release 32, which secures the bolt catch 41 in a downward position until the final round in the magazine is fired. As illustrated in FIGS. 42-48, embodiments of the release mechanism include a manual release that disengages the release retainer and allows the bolt catch to capture the bolt in a rearward position after the next round is fired, regardless of whether that round is the final round. In such embodiments, the release mechanism may comprise a release arm 33. The release arm is pivotally mounted to the main body 31 by a pin 53. The release arm includes an exterior lever 3301 and an interior lever 3302.

The release mechanism also includes a pushpin 43. The pushpin extends through a vertical hole 3104 formed in an arm 3105 of the main body 31. An upper follower 4301 on an upper end of the pushpin contacts a lower surface 3303 of the release arm exterior lever 3301. The pushpin may further include a lower follower 4302 and a lower end of the pin. The lower follower pushes against an upper surface of the release retainer engagement block 4704. When a shooter pushes downwardly on the exterior lever, the pin moves downwardly within the vertical hole. The vertical movement of the pushpin pushes on the engagement block of the release retainer and disengages the engagement tooth 4704 from the catch tooth 3204 of the bolt catch release. As discussed above, when the bolt catch release is disengaged, the bolt catch is biased by spring 48 in an upward position such that it captures the bolt upon the bolt's next rearward stroke. Once the manual release has been actuated, the mechanism may behave as it does, described above, when the bolt catch is released by firing of the final round in a magazine.

We claim:

1. A firearm comprising:

a magazine holding multiple rounds of ammunition, including a final round, the magazine comprising a magazine follower;

a bolt catch movable between a disengaged position and an engaged position;

a magazine catch movable between an engaged position and a disengage position; and a linkage connecting the bolt catch and the magazine catch, the linkage comprising a first link connected to the magazine catch and a second link connected to the bolt catch;

wherein movement of the magazine follower actuates the first link when the final round is removed from the magazine and before the final round is fired thereby moving the magazine catch from the engaged position to the disengaged; and wherein movement of the magazine follower further actuates the second link whereby the bolt catch is moved from the disengaged position to the engaged after the final round is fired.

2. The firearm of claim 1 wherein the first link comprises a lever.

3. The firearm of claim 1 wherein the first link comprises an arm.

4. The firearm of claim 1 wherein the linkage further comprises a spring positioned between the bolt catch and the first link.

5. The firearm of claim 1 wherein the first link translates in a first direction.

6. The firearm of claim 5 wherein the second link translates in a second direction different from the first direction.

7. A firearm comprising:

a bolt catch movable between an engaged position and a disengaged position;

a magazine catch movable between a disengaged position and an engage position;

a linkage connected with the bolt catch and the magazine catch; and a magazine holding multiple rounds of ammunition, including a final round, the magazine comprising a magazine follower;

wherein a surface of the magazine contacts the linkage upon insertion of the magazine into the firearm to move the bolt catch from the engaged position to the disengaged position; and wherein a surface of the magazine follower contacts the linkage when the final round is removed from the magazine and before the final round is fired.

8. The firearm of claim 7 wherein the linkage comprises a first link.

9. The firearm of claim 8 wherein insertion of the magazine moves the first link in a first direction.

10. The firearm of claim 9 wherein movement of the first link in the first direction causes the bolt catch to move in a second direction different from the first direction.

11. The firearm of claim 10 wherein the second direction is opposite to the first direction.

12. The firearm of claim 8 wherein the surface of the magazine contacts the first link upon insertion of the magazine into the firearm to move the magazine catch from the disengaged position to the engaged position.

13. The firearm of claim 12 wherein movement of the first link in the first direction causes the magazine catch to move in a third direction different from the first direction.

14. The firearm of claim 13 wherein the third direction is perpendicular to the first direction.

15. The firearm of claim 8 wherein the linkage comprises a second link, wherein the second link rotates relative to the first link.

* * * * *